US009409670B2

(12) United States Patent
Sylvester

(10) Patent No.: US 9,409,670 B2
(45) Date of Patent: Aug. 9, 2016

(54) BLANKS FOR CONTAINERS, AND CONTAINERS, BOXES, AND METHODS THEREOF

(71) Applicant: Multi Packaging Solutions, Lansing, MI (US)

(72) Inventor: Scott D. Sylvester, Piscataway, NJ (US)

(73) Assignee: MULTI PACKAGING SOLUTIONS, Lansing, MI (US)

( * ) Notice: Subject to any disclaimer, the term of this patent is extended or adjusted under 35 U.S.C. 154(b) by 20 days.

(21) Appl. No.: 13/798,612

(22) Filed: Mar. 13, 2013

(65) Prior Publication Data

US 2013/0299566 A1 Nov. 14, 2013

Related U.S. Application Data

(60) Provisional application No. 61/644,192, filed on May 8, 2012.

(51) Int. Cl.

| | |
|---|---|
| ***B65D 5/42*** | (2006.01) |
| ***B31B 1/26*** | (2006.01) |
| ***B65D 5/22*** | (2006.01) |
| ***B65D 5/24*** | (2006.01) |
| ***B65D 5/44*** | (2006.01) |

(52) U.S. Cl.

CPC ... *B65D 5/42* (2013.01); *B31B 1/26* (2013.01); *B65D 5/22* (2013.01); *B65D 5/241* (2013.01); *B65D 5/443* (2013.01); *B65D 5/445* (2013.01)

(58) Field of Classification Search

CPC ..... B65D 5/248; B65D 5/22; B65D 5/2009; B65D 5/443; B65D 5/241

USPC ..... 229/182, 122.34, 172, 176, 159, 167, 229/173, 174

See application file for complete search history.

(56) References Cited

U.S. PATENT DOCUMENTS

| | | | | |
|---|---|---|---|---|
| 564,592 | A * | 7/1896 | Craw | 229/145 |
| 2,640,642 | A * | 6/1953 | Frankenstein | 206/765 |
| 3,286,900 | A | 11/1966 | Keith | |
| 3,756,499 | A * | 9/1973 | Giebel et al. | 229/117.17 |
| 4,413,726 | A * | 11/1983 | Davidson | 206/45.29 |

(Continued)

FOREIGN PATENT DOCUMENTS

| | | |
|---|---|---|
| DE | 92 02 098 U1 | 8/1992 |
| EP | 2072408 A1 | 6/2009 |

(Continued)

OTHER PUBLICATIONS

European Search Report for Corresponding European Patent Application No. 12 16 4150 filed Apr. 13, 2012, dated Oct. 1, 2012.

(Continued)

*Primary Examiner* — Christopher Demeree

(74) *Attorney, Agent, or Firm* — The Dobrusin Law Firm, P.C.

(57) ABSTRACT

A continuous sheet for forming a blank, the blank adapted for assembly as a container including a base portion and side walls formed from a single continuous sheet. The container includes sufficient support features, such as side wall connection features so that one or more of the side walls are maintained in a generally orthogonal orientation relative to the base portion and so that adjacent side walls are maintained in generally orthogonal orientation relative to each other.

20 Claims, 24 Drawing Sheets

(56) References Cited

U.S. PATENT DOCUMENTS

| | | | | |
|---|---|---|---|---|
| 5,383,595 | A | 1/1995 | Hallam | |
| 5,586,717 | A | 12/1996 | Hallam | |
| 6,012,631 | A | 1/2000 | Hallam | |
| 7,044,359 | B1 | 5/2006 | Cohen | |
| 2006/0163334 | A1 | 7/2006 | Kay | |
| 2006/0202007 | A1 | 9/2006 | Cohen | |
| 2010/0294831 | A1 | 11/2010 | Hallam | |
| 2011/0155797 | A1 | 6/2011 | Hallam | |
| 2011/0200768 | A1 | 8/2011 | Revell et al. | |
| 2013/0299566 | A1* | 11/2013 | Sylvester | 229/122.34 |

FOREIGN PATENT DOCUMENTS

| | | | |
|---|---|---|---|
| EP | 2185431 | A1 | 5/2010 |
| EP | 2262692 | A2 | 12/2010 |
| GB | 2475019 | A | 5/2011 |
| WO | 2006/097683 | A1 | 9/2006 |
| WO | 2007/127742 | A2 | 11/2007 |
| WO | 2007/127742 | A3 | 11/2007 |
| WO | 2009/013542 | A1 | 1/2009 |
| WO | 2009/109783 | A2 | 9/2009 |
| WO | 2009/109783 | A3 | 9/2009 |
| WO | 2010/020815 | A2 | 2/2010 |
| WO | 2010/131040 | A1 | 11/2010 |

OTHER PUBLICATIONS

International Search Report & Written Opinion dated Jun. 24, 2013; Appln. No. PCT/US2013/030671.
Copending U.S. Appl. No. 13/835,896.
PCT International Preliminary Report on Patentability dated Jul. 17, 2014; Application No. PCT/US2013/030671.
PCT Written Opinion of the International Preliminary Examining Authority dated Apr. 17, 2014; Application No. PCT/US2013/030671.
Canadian Office Action dated Apr. 9, 2014; Appln. No. 2,800,628.
European Extended Search Report dated Oct. 1, 2012, Appln. No. 12164150.
Copending U.S. Appl. No. 13/448,681.
European Office Action dated Dec. 7, 2015; Appln. No. 13714075.2.

* cited by examiner

BLANKS FOR CONTAINERS, AND CONTAINERS, BOXES, AND METHODS THEREOF

FIELD OF THE INVENTION

The present invention relates to packaging for a container, blanks for a container, methods of assembly, uses of the container, and methods of using the container.

BACKGROUND OF THE INVENTION

There is an ongoing need in the field of packaging for a container (e.g., a tray that may optionally include a lid) configured for functioning as a tray for display and/or containment of an article, such as a consumer product. There is an ongoing need for an alternative container that is capable of being printed on one or both sides of any paperboard used for making the product (e.g., by pixelated type printing, such as ink-jet, laser jet or other suitable printing devices, by screen printing, or other printing). There is also an ongoing need for a container that can be made from a single sheet of stock material, such as a paperboard material. There is also an ongoing need for a container that is capable of supporting loads from one or more contained articles, without buckling or otherwise plastically deforming from the load of the one or more contained articles.

SUMMARY OF THE INVENTION

One or more of the above needs are met by the teachings herein.

One aspect of the invention is directed at a container comprising a generally rectangular base portion having a first pair of peripheral edges and a second pair of peripheral edges. The container preferably includes a first pair of opposing spaced apart side walls each projecting generally orthogonally from respective edges of the first pair of peripheral edges; a second pair of opposing spaced apart side walls each projecting generally orthogonally from respective edges of the second pair of peripheral edges and being connected with the first pair of opposing spaced apart side walls to define four corners. The container may preferably be constructed from a continuous single sheet having a first face and an opposing second face and wherein one or both of the first face or the second face is adapted for printing directly onto its surface. The base portion preferably includes at least two layers of the single sheet that are folded from the continuous single sheet to define the base portion and cooperate to define a portion of the first and second pair of sidewalls. The container may include an adhesive that bonds at least two layers defining at least one of the side walls.

Another aspect of the invention is directed to a box including one or more of the containers according to the teachings herein.

Another aspect of the invention is directed to a container according to the teachings herein, wherein the container is configured to receive an electronic device, a cosmetic, a kit, an article of clothing, a houseware item, an automotive accessory, paper goods, a food item or any combination thereof.

Yet another aspect of the invention is directed at a blank for a container according to the teachings herein. Preferably the blank is a die cut paperboard preform. The container is preferably made from a single blank. A blank may include features as shown in FIGS. 1 through 9 and 14 through 17, or may be substantially as depicted in any of those figures.

A method related aspect of the invention is directed at a method of making a container, comprising folding a blank (e.g., a die cut paperboard preform) according to the teachings herein, forming a container, such as a container according to the teachings herein.

BRIEF DESCRIPTION OF THE DRAWINGS

FIG. 7 is a top-down view of a portion of an illustrative blank.

DETAILED DESCRIPTION

Figure 1:
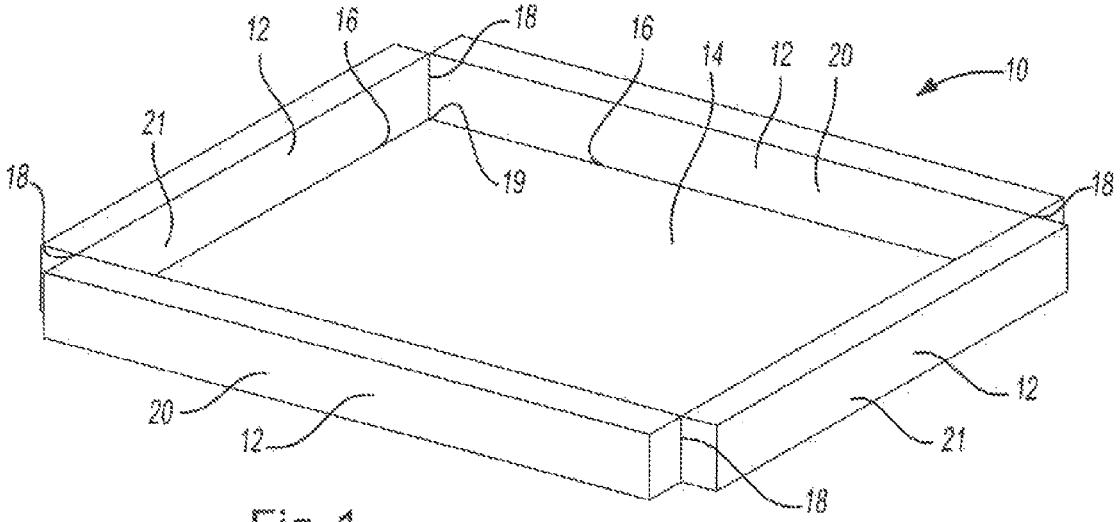
FIG. 1 is drawing of an illustrative container according to the teachings herein.

This application is related to and claims the benefit of the priority date of U.S. Provisional Application Ser. No. 61/644,192, filed on May 8, 2012. The entirety of that application is hereby incorporated by reference for all purposes.

The teachings herein contemplate the structures and features depicted in the accompanying drawings. Variations to the structures and features are also contemplated within the teachings. For example, any dimensions, angles, tolerances and/or proportions shown in the drawings are part of the teachings herein. Departures from the dimensions, angles, tolerances and/or relative proportions shown in the drawings are part of the teachings herein to the extent that such variations do not materially affect the intended operation or functionality of the depicted structures and features. For example, variations in an amount of less than 50%, 30% or 10% are envisioned; variations in an amount of more than 50% 30% or 10% are also envisioned.

Unless otherwise stated or reasonably apparent from the context of the teachings, geometries may vary from those depicted in the drawings. Sharp corners at free ends of the structures may be rounded. Rounded corners at free ends of structures may be sharp.

Perforations depicted in the drawings may be located generally as shown. Additional perforation may be added. Perforations may be omitted. They may be located intermittently substantially entirely along a crease. They may be located along only a portion of a crease (e.g., a total length of slit material being about 90% or less, about 60% or less, about 40% or less, about 20% or less, or about 10 or less).

The container includes a base portion and side walls formed from a single continuous sheet. The container includes sufficient support features, such as side wall connection features so that one or more of the side walls are maintained in a generally orthogonal orientation relative to the base portion, so that adjacent side walls are maintained in a generally orthogonal orientation relative to each other, or both. For example the container may include a sufficient number of support features so that the base portion and any pair of adjacent side walls are generally mutually orthogonal.

Preferred containers include four side walls. Each side wall may be connected to a peripheral edge of the base portion. Each side wall may have two lateral peripheral edges. The lateral peripheral edges of a side wall may be located at opposing edges of the side wall. The lateral peripheral edges of the side walls may be generally orthogonal to the peripheral edge of the base portion. Adjacent side walls may be connected along their lateral side wall edges. The container may have four corners defined by the intersection of a lateral side wall edge and a peripheral edge of the base portion.

The single continuous sheet may be formed of any material capable of being folded to form multiple layers of the container components, such as multiple layers of the walls, multiple layers of the base portion, or both.

The single continuous sheet has a first face and an opposing second face. The thickness of the single continuous sheet the distance between the two opposing faces) may be uniform or may vary. Preferably the single continuous sheet has a thickness that is sufficiently uniform so that it can be made from stock materials (e.g., card stock, sheet stock) or other material having generally uniform thickness. As used herein, a sheet having uniform thickness has thickness with a standard deviation of about 20% or less, about 10% or less, about 5% or less, or about 1% or less. For example, the standard deviation of the thickness may be about 0%.

One or both of the faces of the sheet may be adapted for printing directly on its surface. Preferably at least one of the faces is adapted for printing directly on its surface. For example, the sheet may include one face that is a show surface and an opposing face that is a hidden surface. When folded into a container, one or more portions of the show surface may be visible. When folded into a container, preferably none of the hidden surface is visible. Nevertheless, it may be advantageous to have printing on a hidden surface so that instructions or other features may be provided on that surface. It is also possible to fold a sheet and/or employ openings in a sheet so that portions of both faces are visible.

The container may include any number of layers base layers, wall layers, or both). For example, the base portion may include a plurality of base layers, one or more side walls (e.g., each side wall) may include a plurality of base layers, or both. Although a single layer will generally have insufficient strength to support the container, by using a plurality of stacked layers, a container having sufficient strength may be achieved. The number of base layers that form, the base portion may be about 2 or more or about 3 or more. Preferably, the number of base layers is about 4 or more. The number of side wall layers that form a side wall may be about 2 or more or about 3 or more. Preferably, the number of side wall layers is about 4 or more. Each side wall may have the same number of side wall layers or may differ in the number of side wall layers. Preferably, each side wall has the same number of side wall layers.

The container may have any shape. A preferred container includes a tray shape. The container may be used as a box including a tray portion and a lid portion. For example a box may include a container having a tray portion and an integrated lid portion. Alternatively, a box may include a container and a separate lid portion. As an example, a box may include two trays including a first tray that is used as the bottom of the box and a second tray that is used as the lid or cover of the box. It will be appreciated that a box may include one or more containers according to the teachings herein.

A base layer preferably extends over a majority of, a substantial portion of, or even the entirety of the base portion. The example a base layer may span about 50% or more, about 70% or more, about 90% or more, about 95% or more, or about 99% or more of the base portion, as defined by the ratio of the area of the base layer to the area of the base portion. Preferably the base portion includes 3 or more layers that are folded form a continuous single sheet and span substantially the entirety (e.g., at least about 90% or more, or at least about 95% or more) of the base portion.

A base layer may be divided into a plurality of sections. If a base lay divided into a plurality of sections, two or more of the sections may abut each other along an interior edge (i.e., an edge that is not a peripheral edge of the base portion).

Preferably two sections of a single base layer do not overlap. As such, faces of two sections of the same base layer preferably do not contact one another. The base portion may include a bottom base layer, a top base layer, and one or more intermediate base layers interposed between the bottom as layer and the top base layer. Any base layer that includes a plurality of sections is preferably an intermediate base layer and not a top base layer or a bottom base layer.

The base portion may have any shape, and preferably has a polygonal shape. More preferably the base portion has a generally rectangular shape which may be a square shape. The base portion may have a first pair of peripheral edges along opposing sides of a polygonal (e.g., rectangular) base. The base portion may have a second pair of peripheral edges along different opposing sides of a polygonal base. For example the base portion may have four sides and the two pairs of peripheral edges may define the circumference of the base portion.

The container may include a first pair of opposing, spaced apart side walls that each project generally orthogonally from the respective edges of the first pair of peripheral edges of the base portion. The container may include a second pair of opposing, spaced apart side walls that each project generally orthogonally from the respective edges of the second pair of peripheral edges of the base portion. Preferably the base portion includes four sides and the second pair of opposing side walls are connected to the first pair of spaced apart opposing side walls to define four corners. The base portion preferably includes at least two layers of a continuous single sheet that are folded to define the base portion and that cooperate to define at least a portion of the first and second pairs of side walls.

The single continuous sheet for a base portion may be formed by die cutting a sheet stock material. As such, the single continuous sheet may be a die cut preform for a container. Any material suitable for folding, die cutting, or both may be employed. The sheet material may be a single layered material or may have multiple layers. For example the sheet may include a layer of a polymer, a layer of a paper, or both. A particularly preferred material is a paperboard. Any paperboard may be, employed. The sheet material preferably has a thickness that is sufficiently low so that the sheet can be easily folded, die cut, or both. The thickness of the sheet material preferably is about 2 mm or less, more preferably about 1.5 mm or less, even more preferably about 1.2 mm or less, even more preferably about 1.0 mm or less and most preferably about 0.8 mm or less. The thickness of the sheet material preferably is sufficiently high so that the container can be assembled without having to fold an excessive number of layers of the base portion. The thickness of the sheet material preferably is about 0.1 mm or more, more preferably about 0.2 mm or more, even more preferably about 0.25 mm or more, even more preferably about 0.30 mm or more, and most preferably about 0.35 mm or more. For example, the sheet material may be a paperboard characterized as about 8 point, 10 point, about 12 point, about 14 point, about 16 point, about 18 point, about 20 point, about 22 point, about 24 point, or about 26 point, about 28 point, about 30 point, or about 32 point.

The blank for a container may include regions having creases, regions having slits, regions having perforations, or any combination thereof. Creases preferably are employed in areas that provide a structural feature, such as a connection between two adjacent side walls. Creases are also preferably employed to allow easy folding, defined folding, or both in regions that will be visible in the assembled container. Preferably, the assembled container is free of visible slits or perforations. Perforations and/or slits preferably are employed for folding in regions that are not visible in the assembled container and may not be required to provide a structure between the areas on either side of the fold.

The container may include one or more side wall connection features capable of providing a connection between two adjacent side walls. The two adjacent side walls may meet at a corner of the container and the side wall connection feature may provide strength or structural support to an edge of the container, orientation of the walls at an edge, or both. The side wall connection feature preferably is connected to at least one peripheral edge of a side wall layer. Examples of side wall connection features that may be employed include lateral projections (e.g., tabs), gussets, or both. It will be appreciated that a side wall connection feature that is not connected to a side wall layer may also be employed. However, it is preferred that each side wall connection feature is connected to at least one side wall layer so that a single sheet may be used for all of the components and layers of the side walls that meet at a corner.

The container may include lateral projections that project from a lateral peripheral edge of a side wall layer. Such projections may be a tab or other feature capable of orienting in a direction so that it forms part of an adjacent side wall. The lateral projection may provide reinforcement to a side wall. The lateral projection may provide support and or reinforcement for a corner. For example, a lateral projection may provide sufficient reinforcement for a container so that the corner does not tear during use. Preferably the lateral projection is of a sufficient size (e.g. length width or both) so that the walls of the corner are maintained in a generally upright orientation. A blank preferably include a sufficient number of lateral projections that are arranged so that each of the corners is supported and/or reinforced by a lateral projection.

The container may include one or more side wall connection features that are connected to two side wall layers of adjacent side walls (e.g., orthogonal side wall layers). Such side wall connection features may be a gusset or other feature capable of folding and/or orienting in a direction so that it forms part of one of the side walls, while maintaining a connection with an adjacent side wall. The gusset may provide reinforcement to a side wall. The gusset may provide support and or reinforcement for a corner. For example, a gusset may provide sufficient reinforcement for a container so that the corner does not tear during use. Preferably the gusset is of a sufficient size (e.g. length width, or both) so that the walls of the corner are maintained in a generally upright orientation. A blank preferably includes a sufficient number of gussets that so that each of the corners is supported and/or reinforced by a gusset.

The container may include an adhesive for attaching some or all of a face of a first layer to the face of a second layer. For example, adhesive may be employed for attaching two facing surfaces of side wall layers, for attaching two facing surfaces of two base portion layers, or both. Preferably one or more side walls of the container includes an adhesive for attaching two adjacent side wall layers. The adhesive may be provided to one or both of the faces to be attached. The adhesive may be selected to provide a durable adhesion to the surfaces being attached. The adhesive may be characterized as a glue, a curable adhesive, a one-part adhesive, a two-part adhesive, a polar adhesive, a non-polar adhesive, a reactive adhesive, an adhesive that covalently bonds to a surface, an adhesive that bonds to a surface with van der Waals forces, or any combination thereof. The adhesive may be provided on the entirety of a surface or on a portion of a surface. For example, the adhesive may be provided as a pattern on a surface, as a uniform layer, irregularly, along a periphery of a surface, or any combination thereof. More preferably, one side wall includes a plurality of pairs of surfaces (e.g., two or more pairs of facing surfaces, three or more pairs of facing surfaces, or even all pairs of facing surfaces) that are attached with an adhesive. For example, a container may include a single wall that includes two or more (e.g., three or more) pairs of facing layers that are attached with an adhesive. Preferably only one wall of the container includes adhesive.

The container may be free of a separate insert. The container preferably is free of separate insert components and cover components (i.e., that are not part of a single sheet). As such, the process may be free of a step of covering one or more surfaces of an insert made from a first sheet with a cover made from a second sheet, such as a second sheet that is the same or different (e.g., different thickness, different material, different shape, or any combination thereof) from the first sheet.

The single sheet blank preferably is free of attachment features (e.g., protrusions) and corresponding openings, such as slits or slots for connecting two regions of a blank, or for connecting two components of a container (e.g., for connecting an insert component to a cover component). As such, the process of assembling the container may be free of a step of inserting an attachment feature into an opening (e.g., a slit or slot). For example the container may be free of an attachment feature that secures a first layer to a second layer by inserting a feature of the first layer into an opening of the second layer.

FIG. 1 is an illustrative container 10 showing features of a container according to the teachings herein. The container 10 may include a base portion 14 that is generally polygonal in shape. For example the base portion 14 may have a generally rectangular shape. The base portion 14 may have peripheral edges 16. For example the perimeter of the base portion may be defined by the peripheral edges 16. The container 10 may have a tray-like shape including a plurality of side walls 12. For example the side walls 12 may extend from the peripheral edges 16 of the base portion 14. The container 10 may include a first pair of side walls 20, a second pair of side walls 21, or both. A pair of side walls 20, 21 may be spaced apart, parallel, have the same length, or any combination thereof. Preferably, a pair of side walls 20, 21, are spaced apart, parallel, and have the same length (e.g., in the direction of the peripheral edge 16 of the base portion 14 where the side wall and the base portion form an edge of the container 10. The container may include lateral side wall edges 18 where two adjacent side walls 12 meet. The container may include one or more side wall connection features (not shown) that connect two side walls 12. Preferably, the side walls 12 are oriented generally orthogonally to the base portion 14. The container 10 may include corners 19 (e.g., four corners) where two side walls 12 and the base portion 14 meet.

Figure 2:
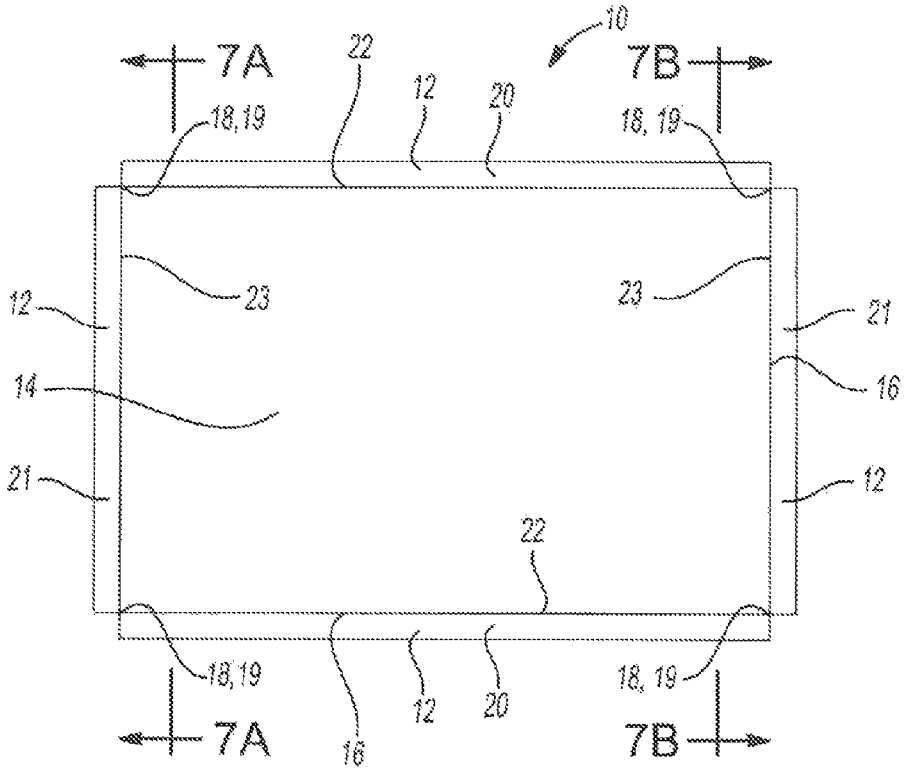
FIG. 2 is a top-down view of an illustrative container according to the teachings herein.

A top view of a container 10 is shown in FIG. 2 illustrating features according to the teachings herein that may be employed in a container or a blank for a container. The base portion 14 may include a first pair of peripheral edges 22, a second pair of peripheral edges 23, or both. A pair of peripheral edges 22, 23, may be characterized as being spaced apart, having the same length, being parallel, or any combination thereof. Preferably, a pair of peripheral edges 16 are spaced apart, have the same length, and are parallel. More preferably, each of the first pair of peripheral edges 22, and the second pair of peripheral edges are paced apart, have the same, length, and are parallel.

Figure 3:
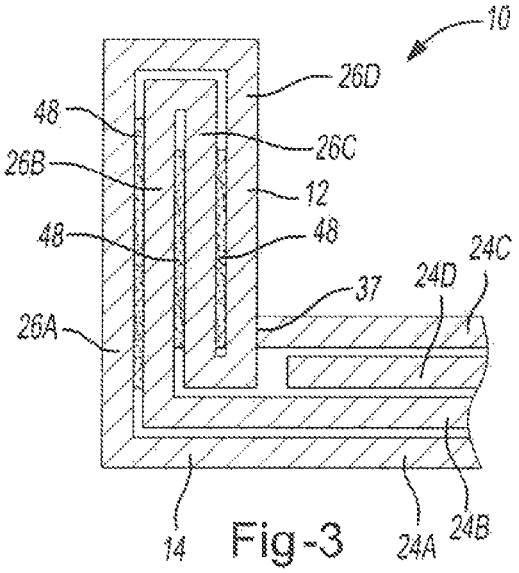
FIG. 3 is a cross-sectional view of an illustrative portion of a container according to the teachings herein.

A cross-section of a portion of a container 10 is illustrated in FIG. 3. The cross-section shows features that may be included in a wall 12, features that may be included in a base portion 14, or both. For example, the base portion 14 may include a plurality of base layers 24. The base layers 24 may be stacked. Facing base layers 24 may contact each other over a portion or the entirety of their facing surfaces. The base portion 14 may include a base layer 24A that is on the bottom of the stack of base layers. The base portion 14 may include a base layer 24D that is on the top of stack of base layers. The base portion may include on or more intermediate base layers 24B, 24C that are interposed between the top base layer and the bottom base layer. One or more of the base layers 24 may be sufficiently long so that it forms a contact with a side wall 12 and a compressive force is established that maintains the position of the base layer. For example, the top base layer 24D may form a sufficient compressive force with a side wall 12 so that the top base layer 24D and the layers below it are maintained in a stacked arrangement. The number of base layers may be two or more, three or more, or four or more.

Figure 4A:
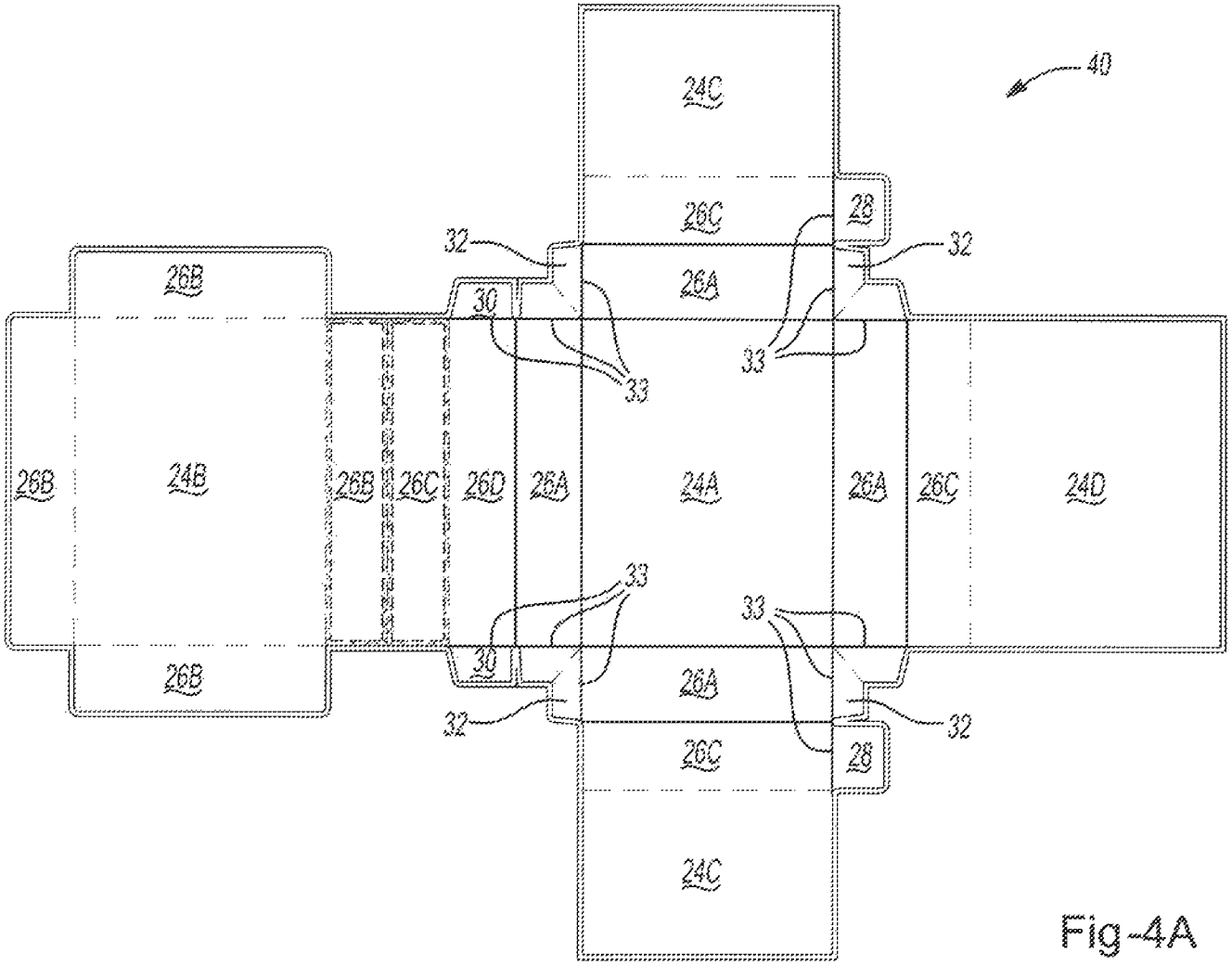
FIG. 4A is a top-down view of a blank illustrating features that may be used in a blank for a container according to the teachings herein.

The side wall 12 may include a plurality of wall layers 26. The wall layers in a side wall 12 may be in a generally stacked arrangement. The side wall may include two or more wall layers. Preferably the side wall includes three or more wall layers. More preferably, the side wall includes four or more wall layers. FIG. 3 illustrates a wall 12 having an adhesive 48 between two facing surfaces of adjacent wall layers. It will be appreciated that some or all of the side wall layers in a side wall may be attached to an adjacent layer using an adhesive. According to the teachings herein, other side was (for example all of the other side walls) may be free of an adhesive attaching adjacent wall layers. The side wall 12 may include outer side wall layers 26A, 26D. The side wall 12 may include one or more intermediate side wall layers 26B, 26C, interposed between the outer wall layers 26A, 26D. All of the wall layers of one side may be connected by sequential folds. For example, the side wall illustrated in FIG. 3 has cuter wall layers 26A and 26D that are connected by a fold wall layers 26D and 26C that are connected by a fold, and wall layers 26C and 26B that are connected by a fold. It will be appreciated that for other side walls, the wall layers may not be sequentially connected. Preferably for ail of the side walls 12, the outer wall layers 26A and 26B are connected by a fold, such as fold along a crease. As illustrated in FIG. 3, all of the adjacent faces of the wall layers (e.g., 26A and 26B; 26B and 26C; 26 C and 26D) may be attached using an adhesive 48. As illustrated in FIGS. 3 and 4A. a wall layer (e.g., 26A, 26B, 26C, or 26D) may extend substantially the entire length of a wall (e.g., horizontal direction of the upright wall).

Figure 4B:
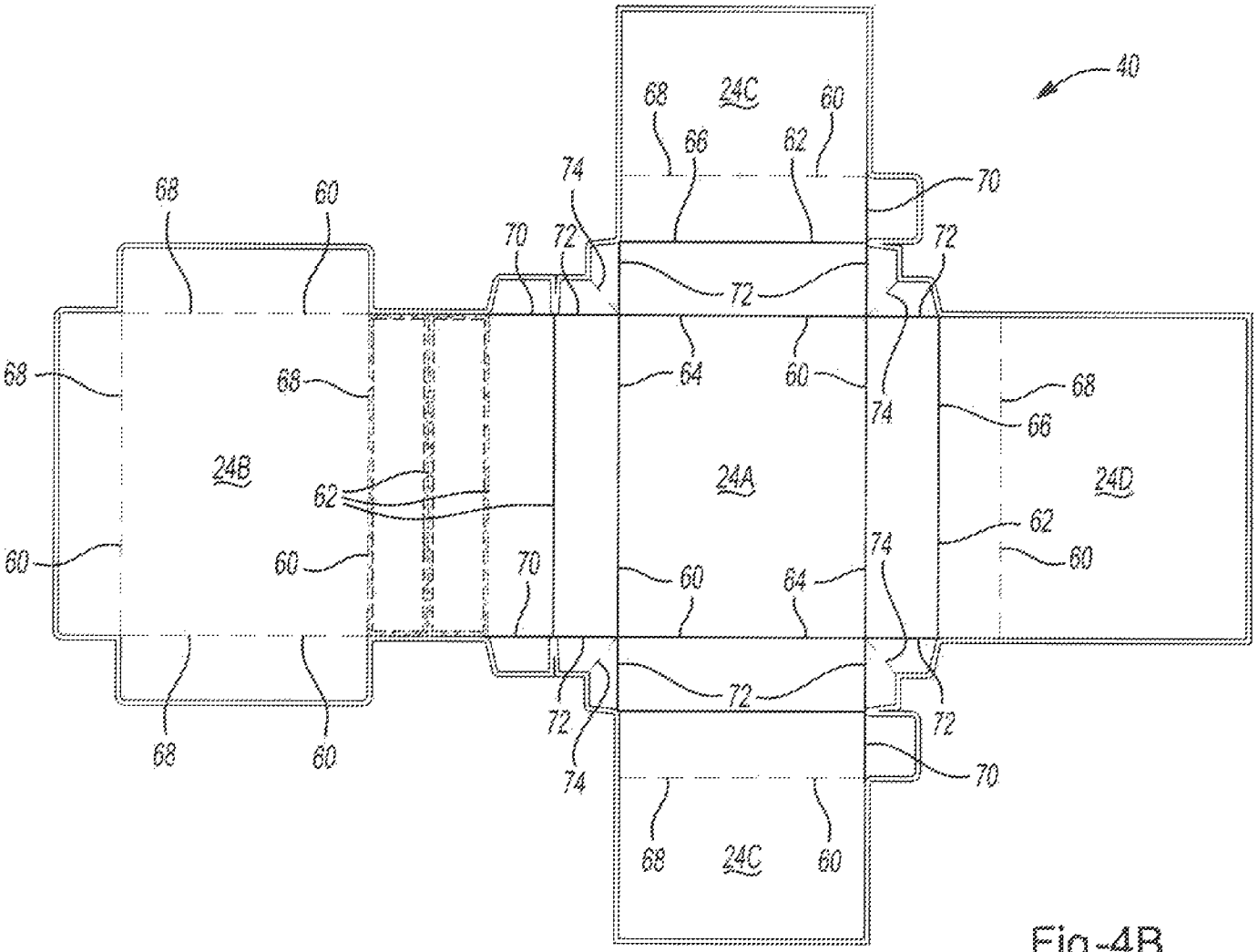
FIG. 4B is a top-down view of a blank illustrating features that may be used in a blank for a container according to the teachings herein.
Figure 4C:
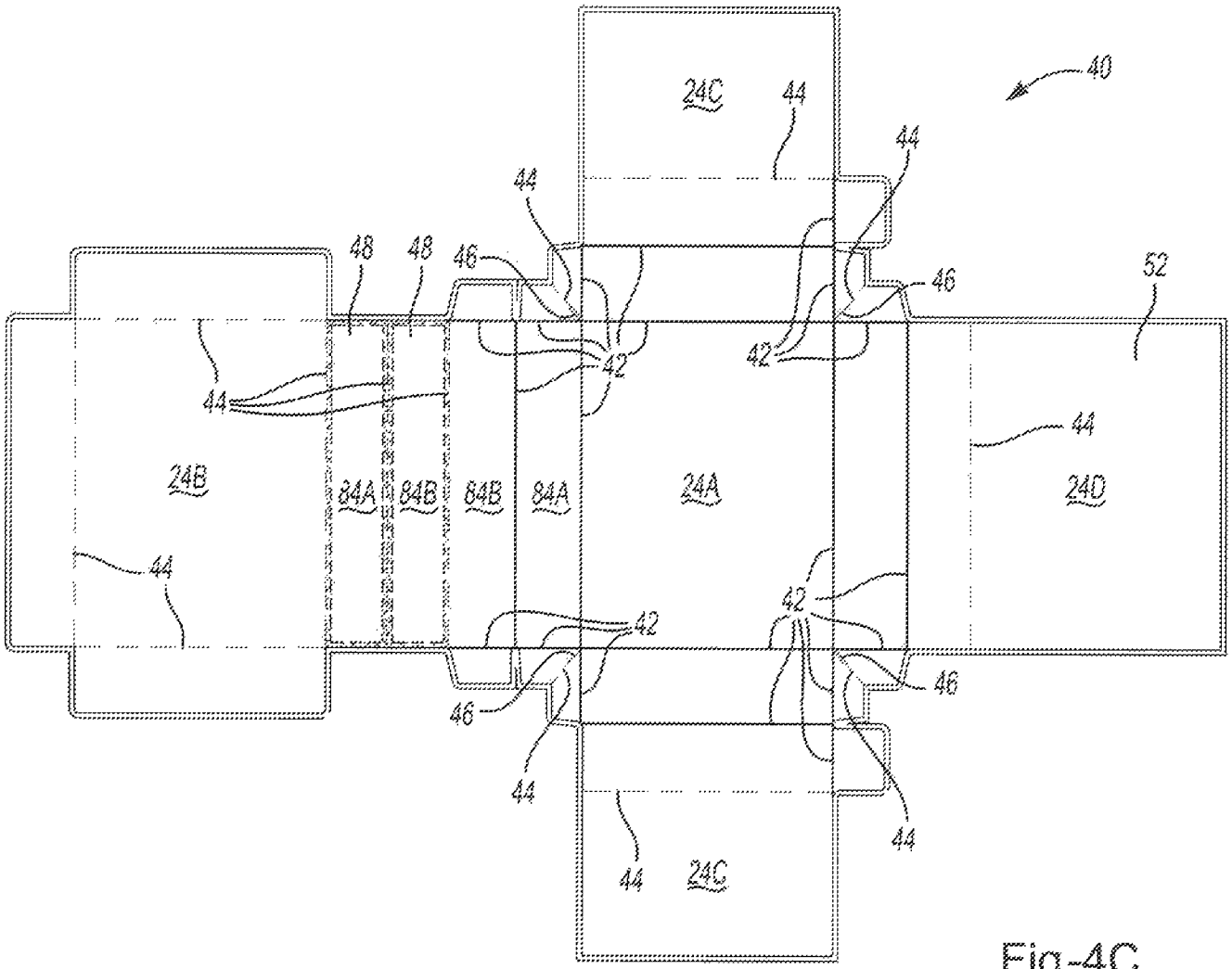
FIG. 4C is a top-down view of a blank illustrating features that may be used in a blank for a container according to the teachings herein.
Figure 4D:
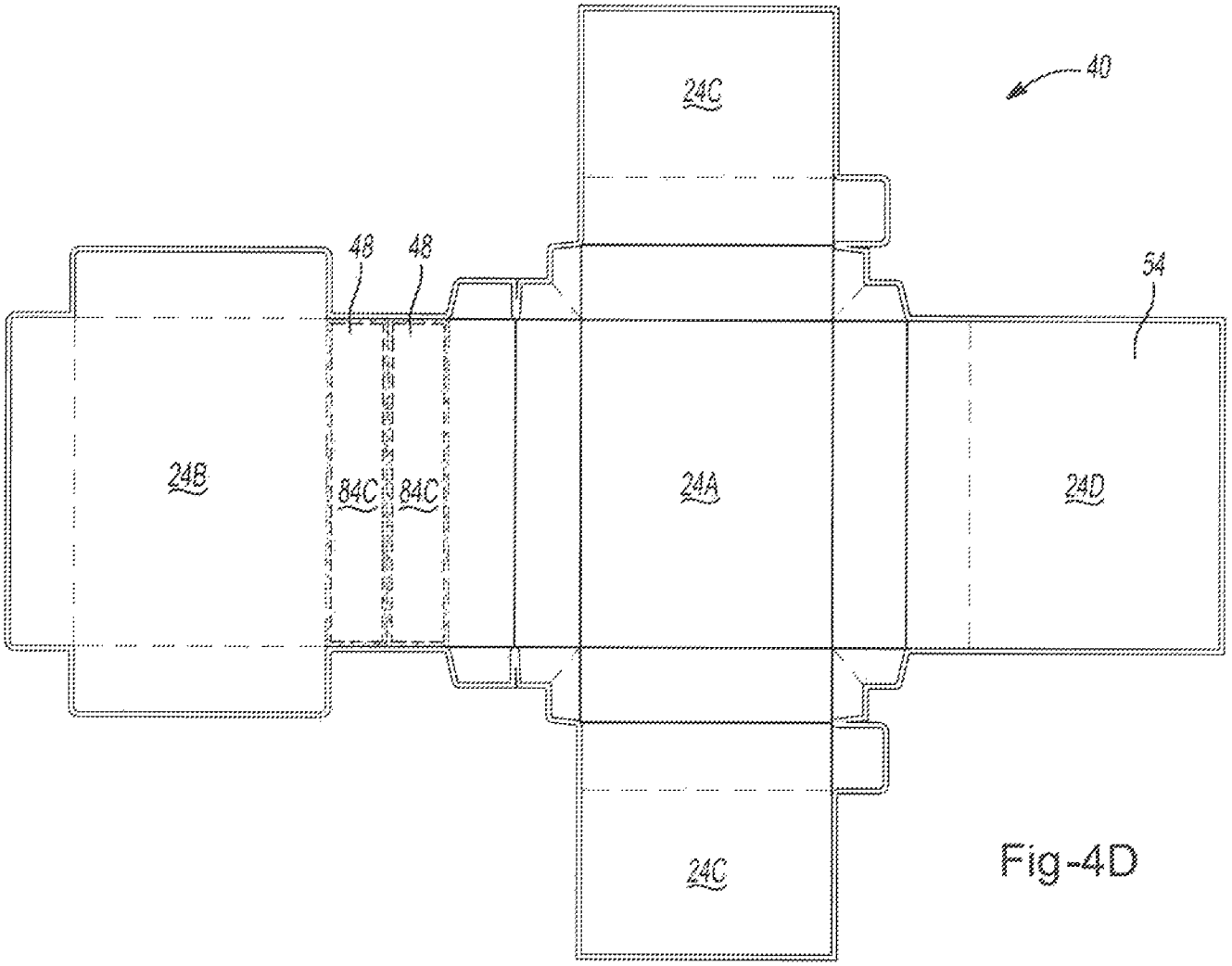
FIG. 4D is a bottom view of a blank illustrating features that may be used in a blank for a container according to the teachings herein.

FIGS. 4A, 4B, 4C, 4D, and 4E are drawings illustrating a blank 40 that may be used for a container according to the teachings herein. The blank may have any or all of the features illustrated in FIGS. 4A, 4B, 4C, 4D, and 4E. The blank may include a plurality of wall layers 26 and a plurality of base layers 24 that are provided as a single continuous sheet. The lateral peripheral edges 33 of some of the wall layers 26 may be connected to a wall connection feature, such as a gusset 32, or a lateral projection 28, 30. As illustrated in FIG. 4A, one or more of the layers (e.g., a base layer 24C) may be divided into a plurality of segments. When the blank 40 is folded into a container 10, the segments of the base layer 24C may form a single base layer, may abut one another, or preferably both. Preferably, the two segments 24C do not overlap one another. With reference to FIGS. 4B, 4C and 4D, the blank 40 may include an edge of a base layer that is connected to a side wall 60. The blank may include a common edge between two side wall layers 62. The blank 40 may include a bottom base layer 24A having edges 64 that are connected to wall layers. The blank 40 may include edges 66 of a side wall layer 26A that are connected to an intermediate side wall layer (e.g., 26C or 26D). The blank 40 may include an edge 68 of other base layers (other than the bottom base layer) that are connected with a side wall layers. The blank 40 may include an edge 70 of a side wall layer that is connected to a lateral projection, such as a tab. The blank 40 may include an edge 72 of a side wall layer that is connected to a gusset. The blank may include surfaces that are later attached to each other using an adhesive (e.g., 84A, 84B, and 84C). The blank may include regions 74 that connect two parts of a gusset so that the gusset can be folded. The blank may include one base layer (e.g., a bottom base layer) 24A having edges 66 connected to opposing side wall layers 26A, and a second base layer 24B having edges connected to opposing side wall layers 26B.

Figure 4E:
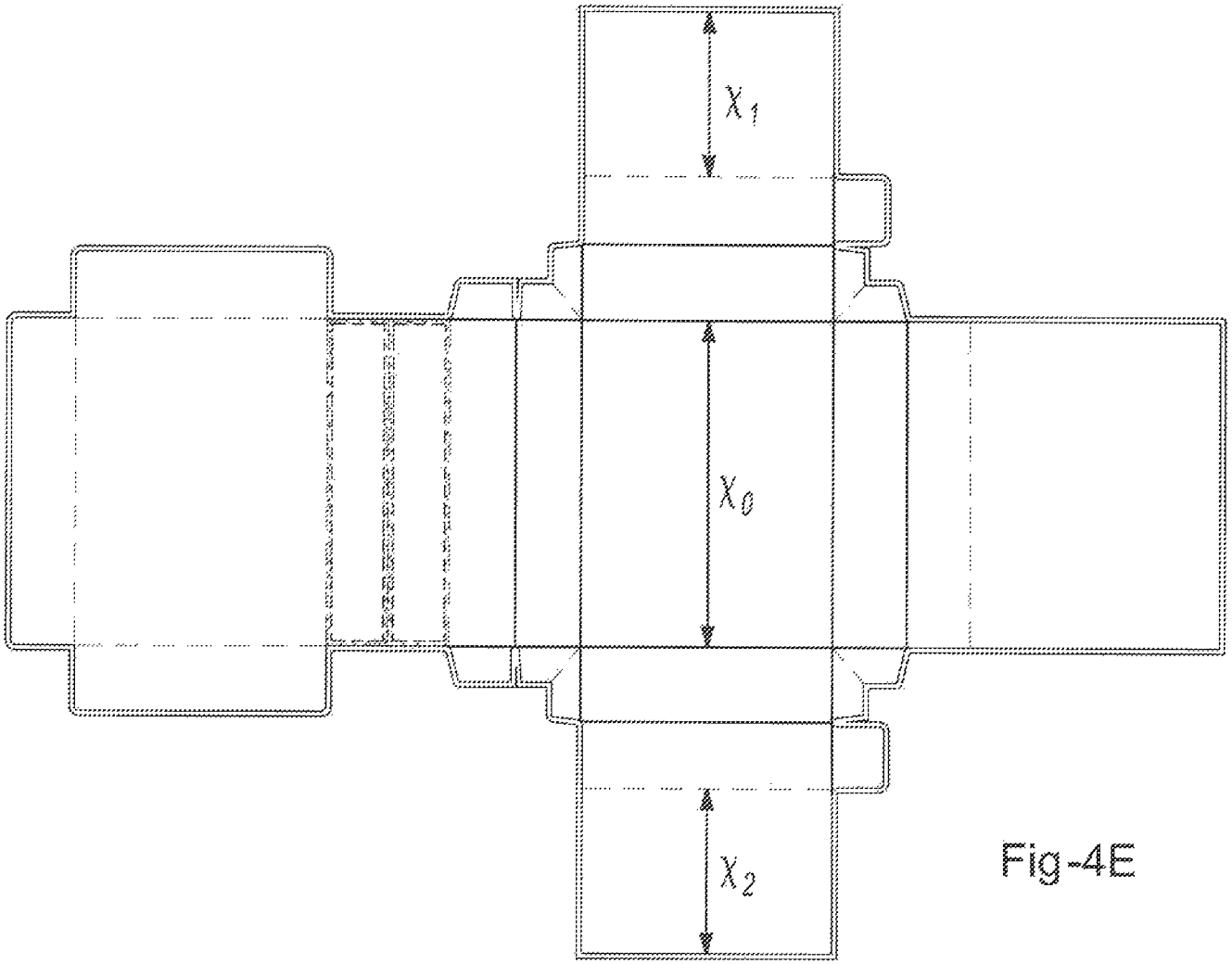
FIG. 4E is a top-down view of a blank illustrating features that may be used in a blank for a container according to the teachings herein.

Folding of a blank may be facilitated by the employment of one or more creases, one or more perforations, one or more cuts (such as a slit or other opening), or any combination thereof. FIG. 4C illustrates regions that may be folded. With reference to FIG. 4C, these regions may include a crease 42, a perforation, 33, or a cut 46, or any combination thereof. It will be appreciated that cuts, perforations and creases may be interchanged provided that the folding and assembly of the container is maintained. FIG. 4C illustrates a first face 52 of the blank 44, and FIG. 4D illustrates a second face 54 of the blank. FIG. 4E illustrates a relationship between the dimensions of two of the base layers that may be employed in a blank according to the teachings herein.

Figure 5:
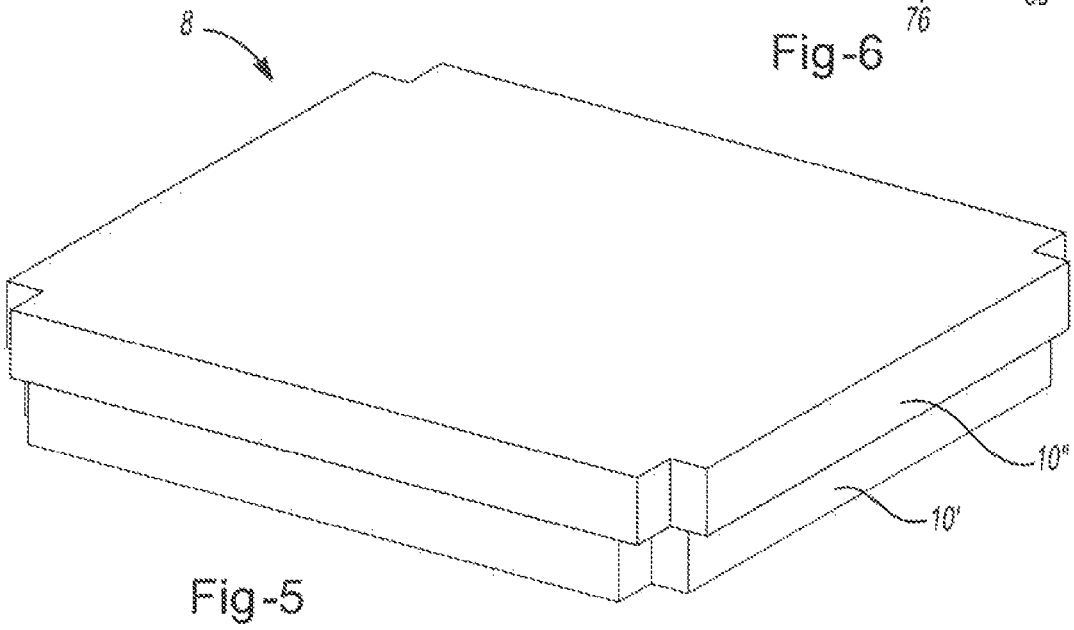
FIG. 5 is a drawing of an illustrative box including one or more containers according to the teachings herein.

FIG. 5 illustrates a box 8 including a first container 10 according to the teachings and a second container 10 according to the teachings herein.

Figure 6:
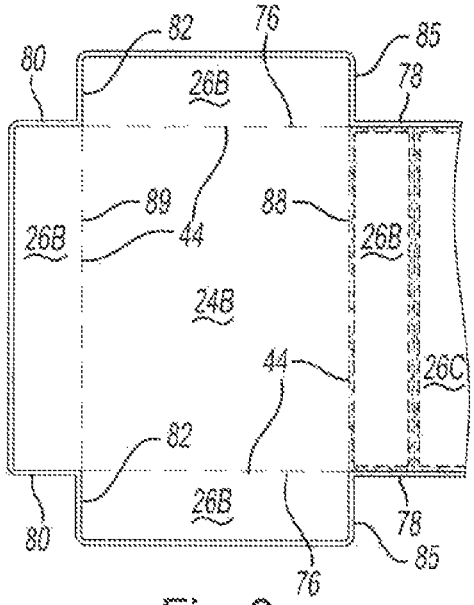

FIG. 6 illustrates features of an intermediate base layer 24B and an intermediate wall layer 26B that may be employed in a container according to the teachings herein.

Figure 7A:
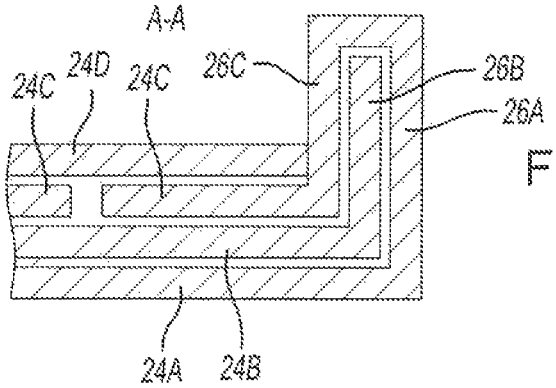
FIGS. 7A and 7B are illustrative partial cross-section of different regions of a container showing illustrative features of a wall and a base that may be employed according to the teachings herein.
Figure 7B:
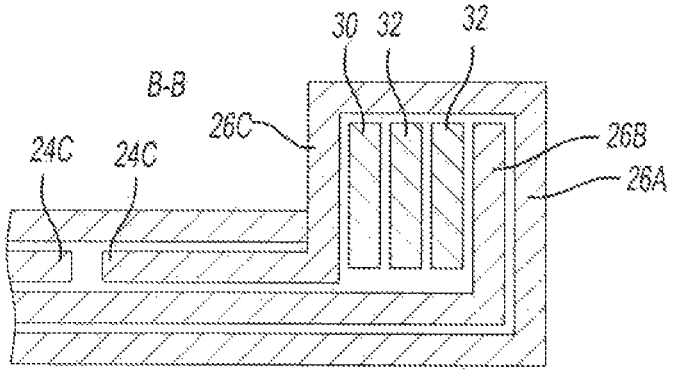
Figure 7C:
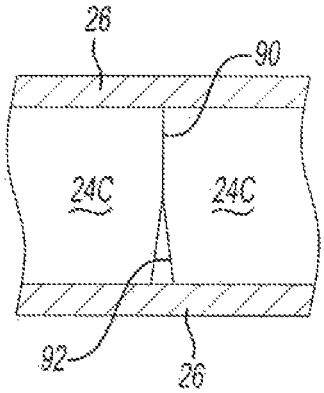
FIG. 7C is an illustrative top-down view a partially constructed container showing features of a layer of a base that may be employed in a container according to the teachings herein.

FIGS. 7A and 7B illustrate cross-sections of a container from two regions of a container such as illustrated by A-A and B-B in FIG. 2. As illustrated in FIGS. 7A and 7B, the wall layers may have, different thicknesses in different regions. As such, the mating of the segments of a base layer 24C may be tighter in one region 90 than in another region 92, as illustrated in FIG. 7C. This may allow for easier assembly of the layer 24C.

Figure 8:
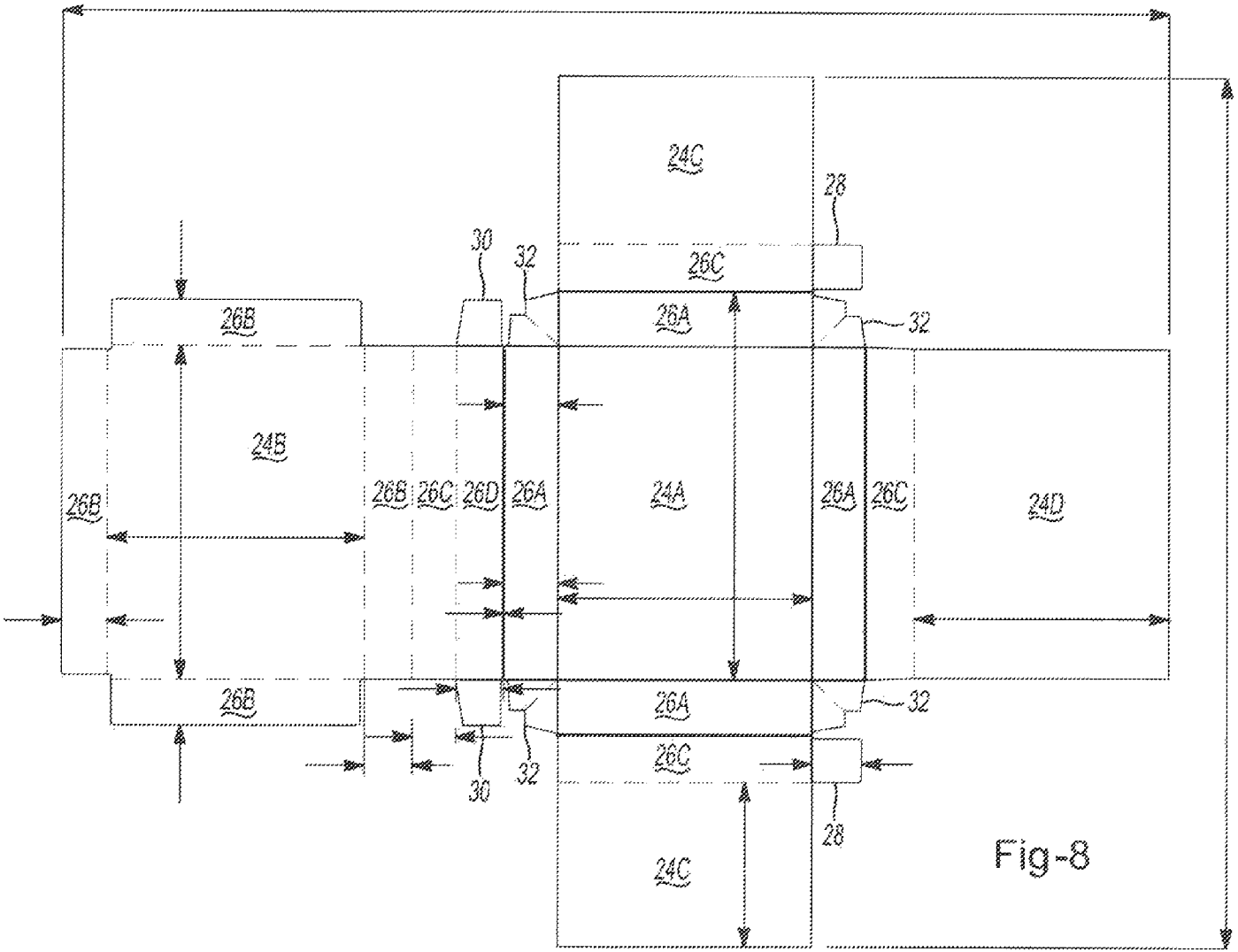
FIG. 8 is a top-down view of a blank for a container illustrative features of a container according to the teachings herein.
Figure 9:
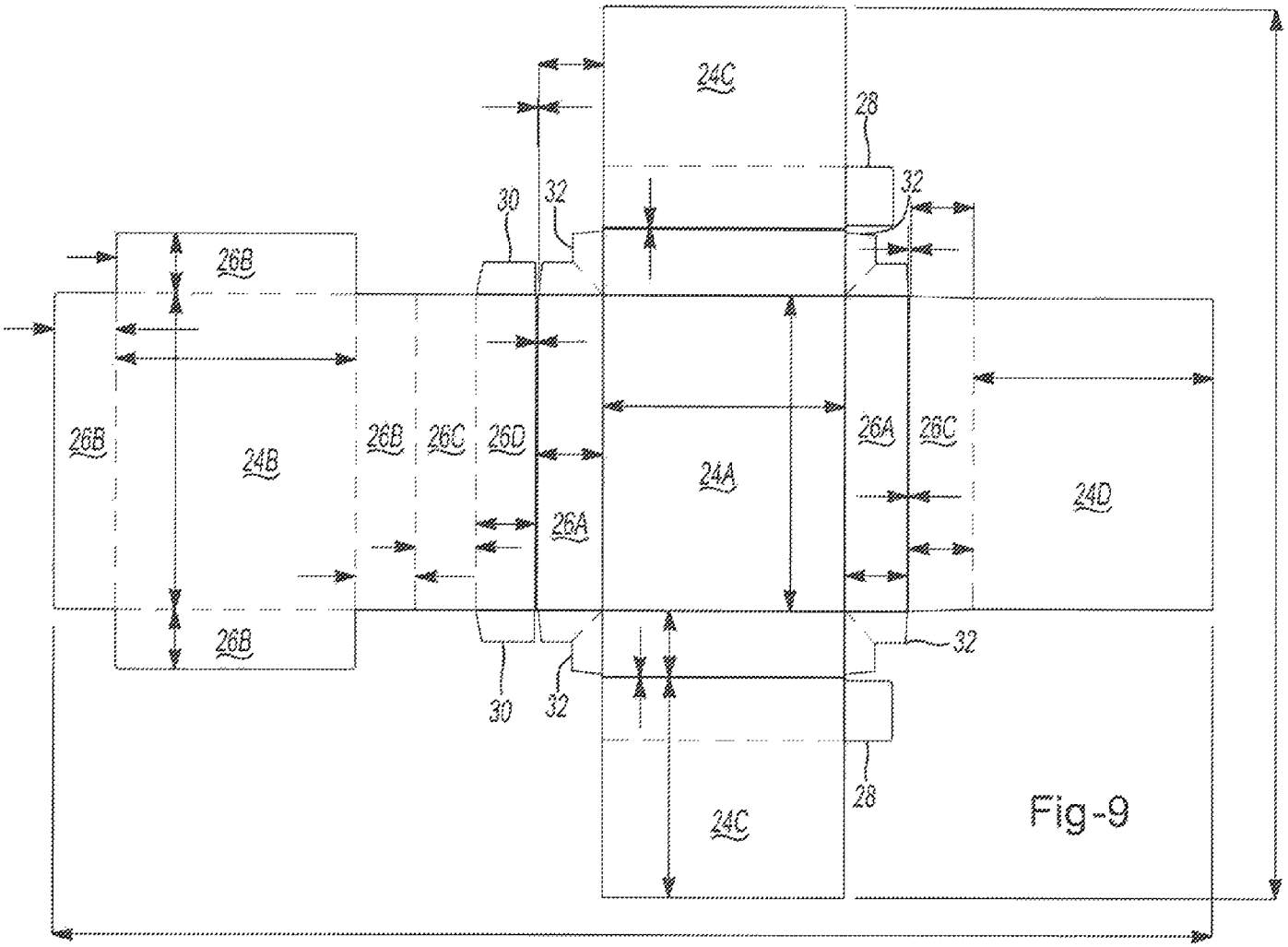
FIG. 9 is a top-down view of a blank for a container illustrating features of a container according to the teachings herein.

FIGS. 8 and 9 illustrate exemplary dimensions of a blank. One or more of the features of the blank may have dimensions that are in the same relationship (e.g. larger than, smaller than, the same size as, having a difference in size greater than, having a ratio of about, etc.) that is about the same as the relationships shown in these figures. Other relationships are also possible. As an example, base layers, 24A, 24B and 24D may each have a width and length that is greater than that of 24C. Base layers 24A, 24B and 24D may each of substantially the same width and length. Wall layers 26A, 26B, 26C, 26D may each have substantially the same width. Wall layers 26A, 26B, 26C, 26D may each have substantially the same width as any adjacent wall layer.

Figure 10:
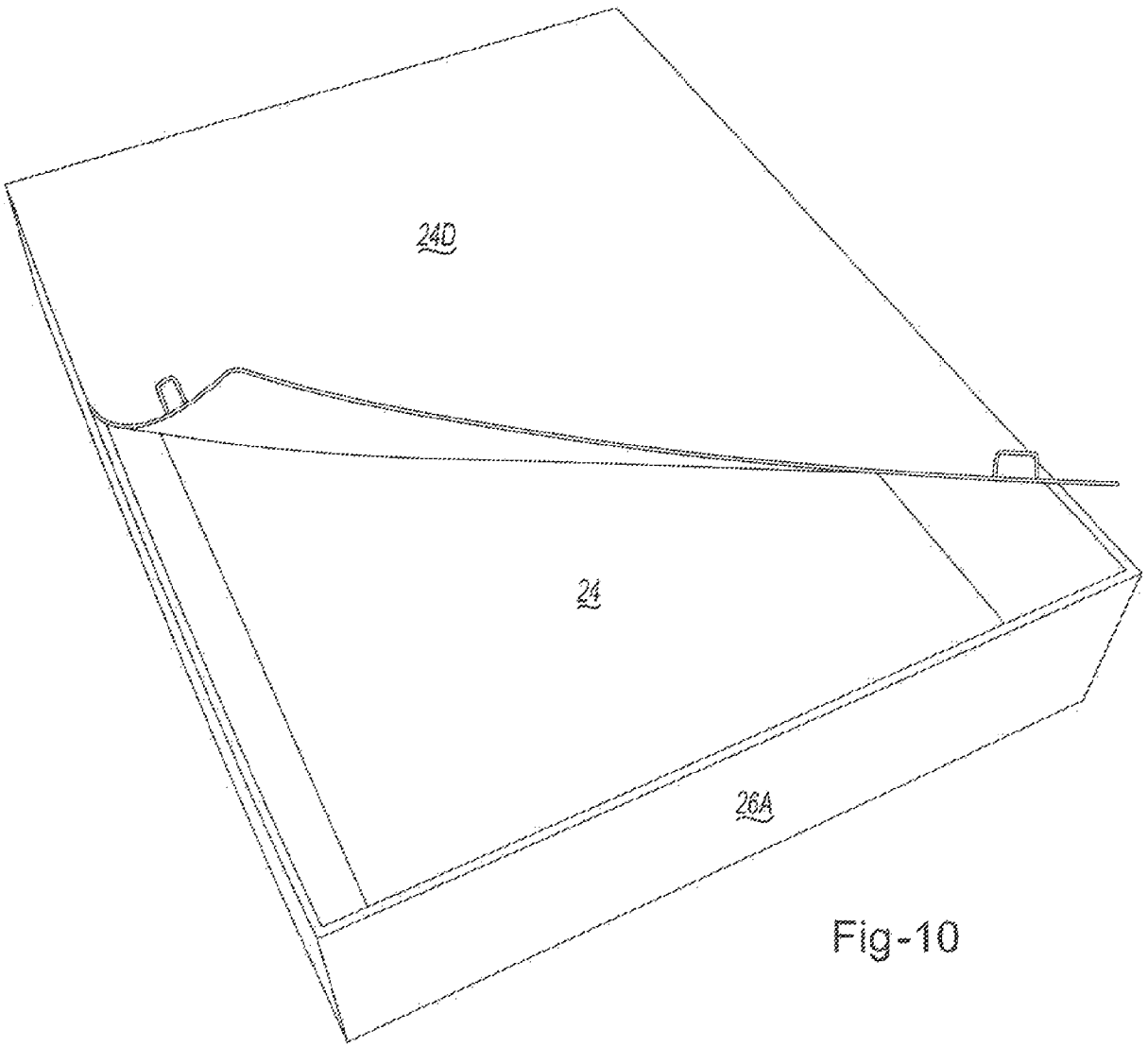
FIG. 10 is a perspective view an illustrative example of a container in accordance with the present teachings.

FIG. 10 shows a nearly fully assembled container showing base layer 24D being located onto another base layer 24 (which may be 24A, 24B or 24C). The exterior wall layer 26A is visible about the exterior edge of the container.

Figure 11:
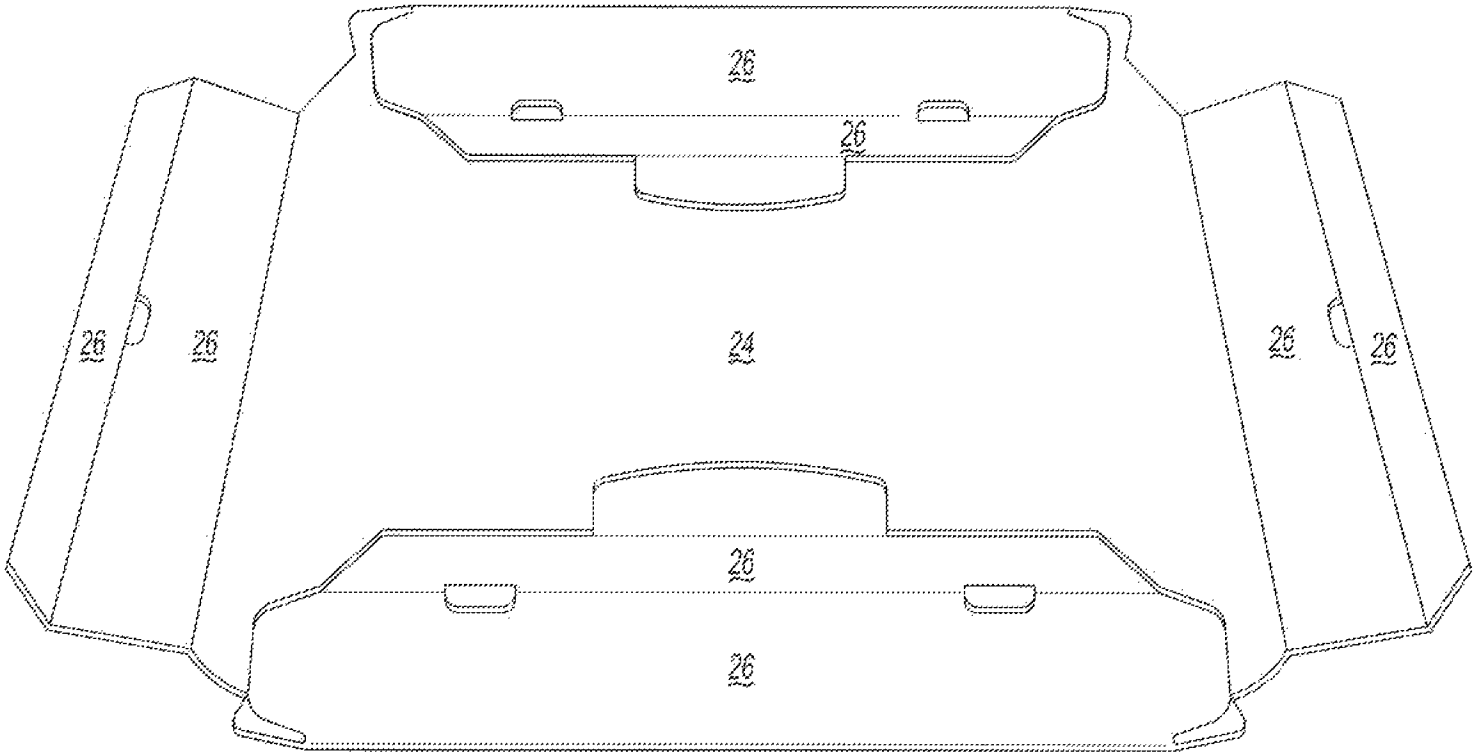
FIG. 11 is a perspective view of an illustrative example of a partially assembled container in accordance with the present teachings.
Figure 12:
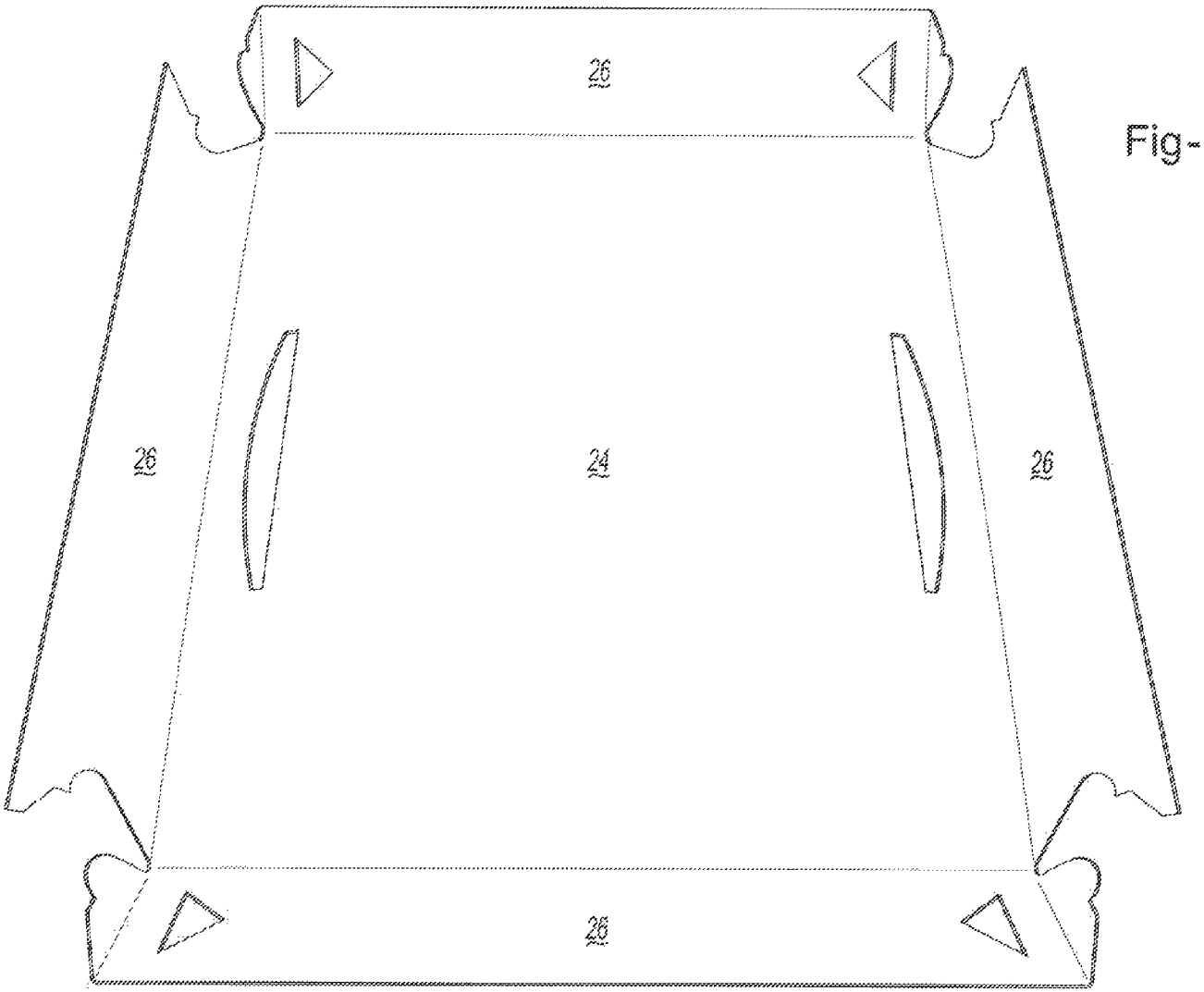
FIG. 12 is a perspective view of an illustrative example of a partially assembled container in accordance with the present teachings.
Figure 13:
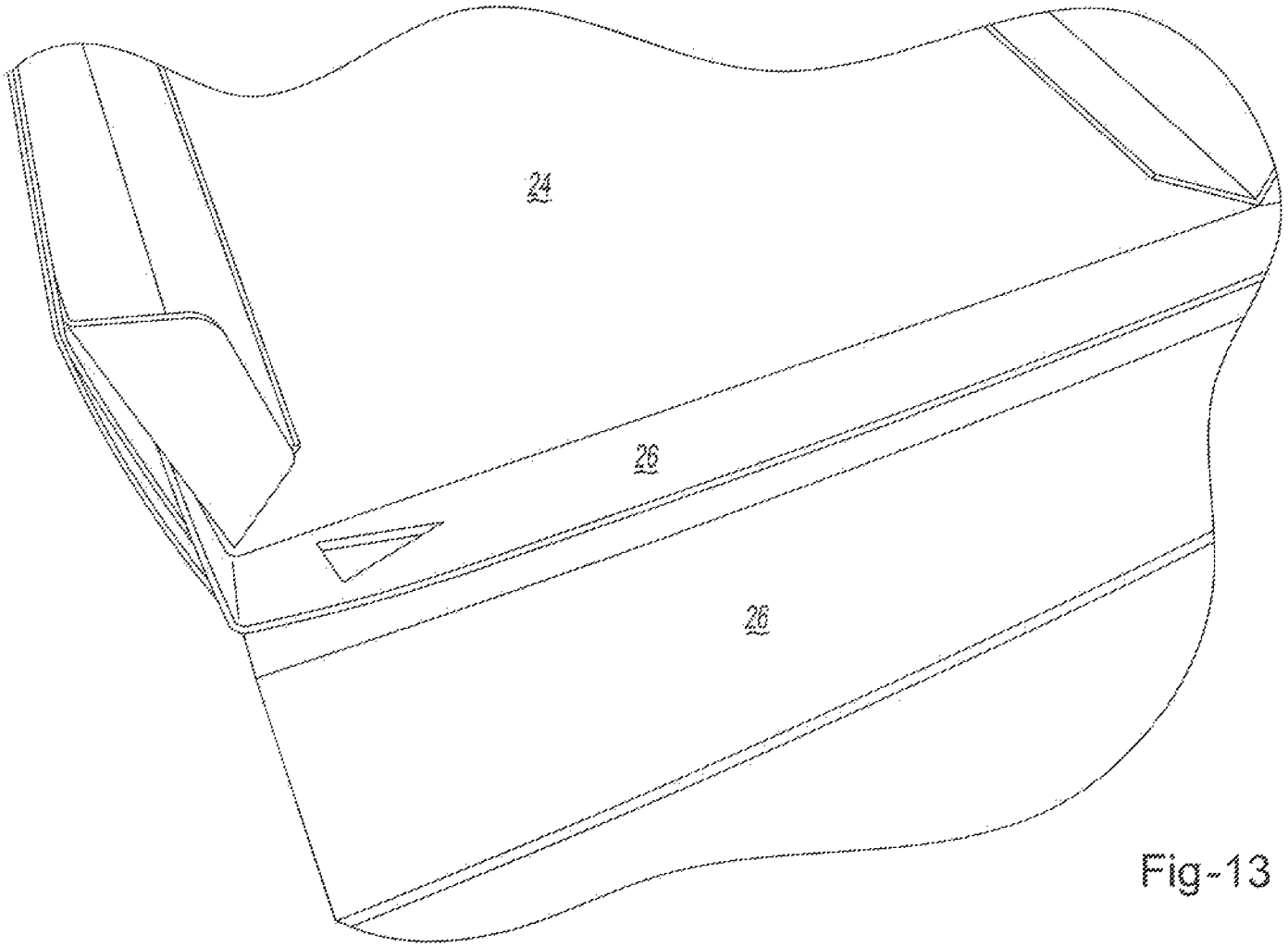
FIG. 13 is a view of an illustrative example of a corner of a partially assembled container in accordance with the present teachings.

FIG. 11 illustrates an example insert portion of a container in the event that the container includes separate inserts as opposed to be formed from one integrally formed blank. Similar to an integrally formed blank, the insert may include a base layer 24 and wall layers 26. The insert may be located within a shell portion (not shown) whereby the shell portion also includes a base layer and wall layers. FIGS. 12 and 13 illustrate additional embodiments of inserts that may be included in forming the container. The containers according to the teachings herein may be free of one or any combinations of the features illustrated in FIGS. 10-13.

Figure 14A:
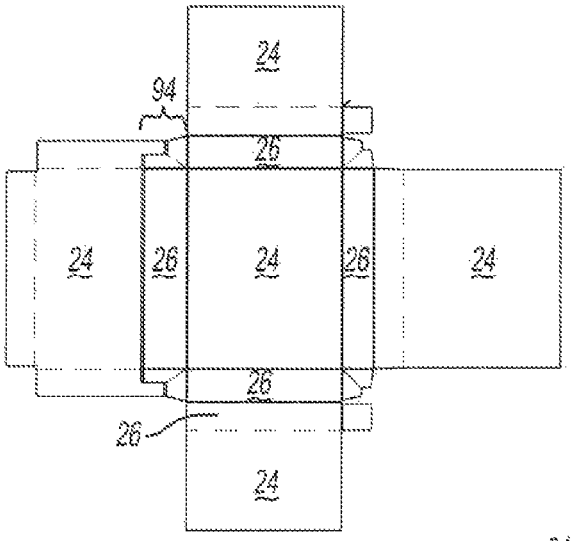
FIGS. 14A, 14B, and 14C are top-down views of illustrative blanks according to the teachings herein.
Figure 14B:
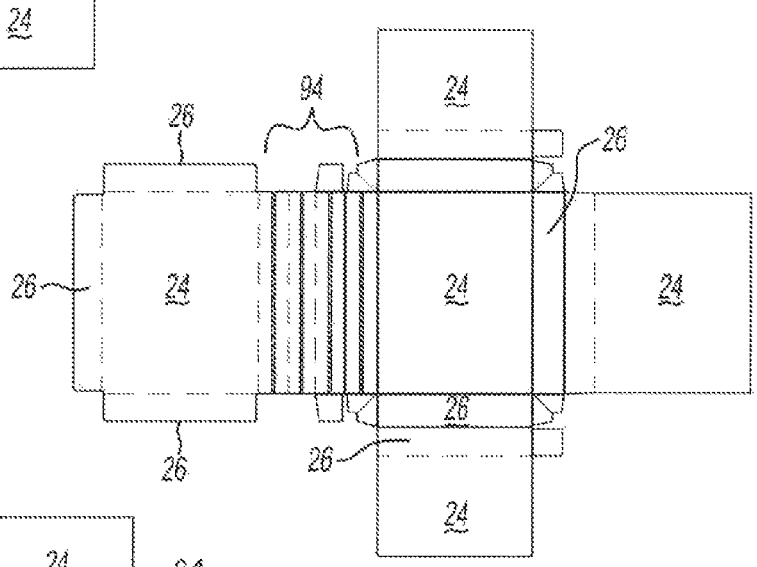
Figure 14C:
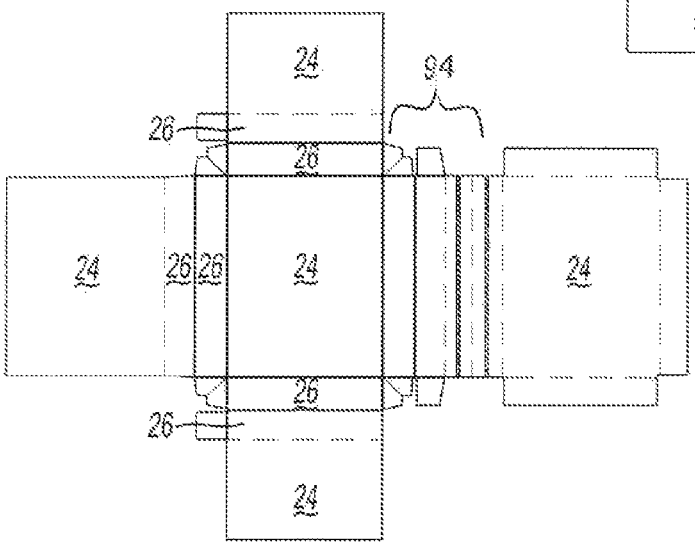

FIGS. 14A, 14B, and 14C illustrate features of a blank according to the teaching herein. Specifically, FIGS. 14B and 14C illustrate opposite faces of the blank prior to the application of an adhesive for connecting a plurality of adjacent wall layers 94. FIG. 14A illustrates a face of the blank after 4 adjoining wall layers 94 have been attached using an adhesive.

Figure 15A:
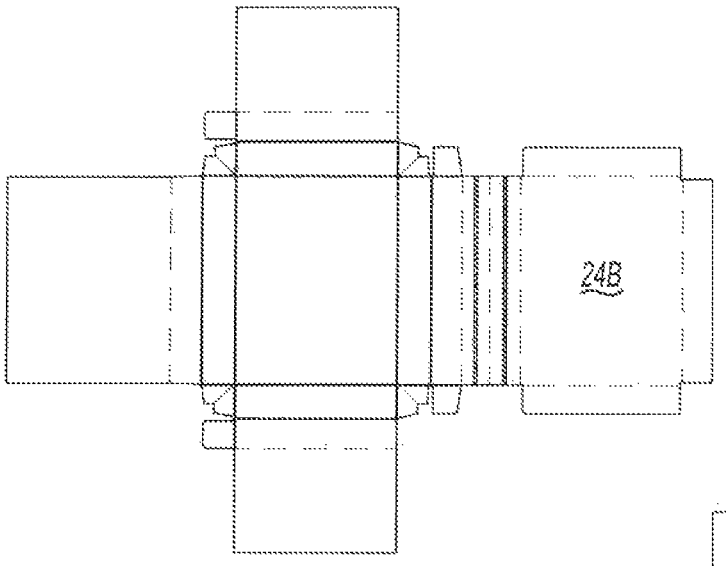
FIGS. 15A-15C are top-down views of illustrative blanks according to the teachings herein.
Figure 15B:
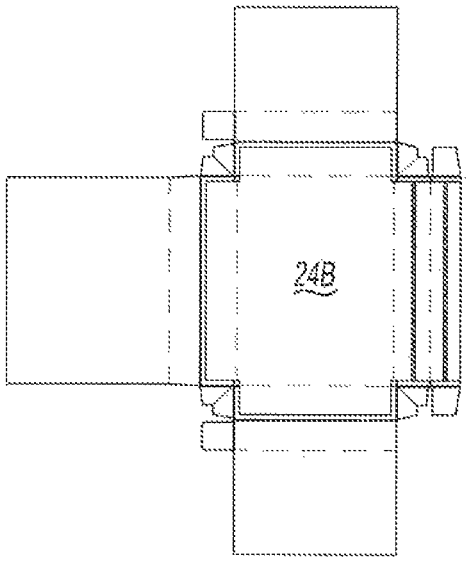
Figure 15C:
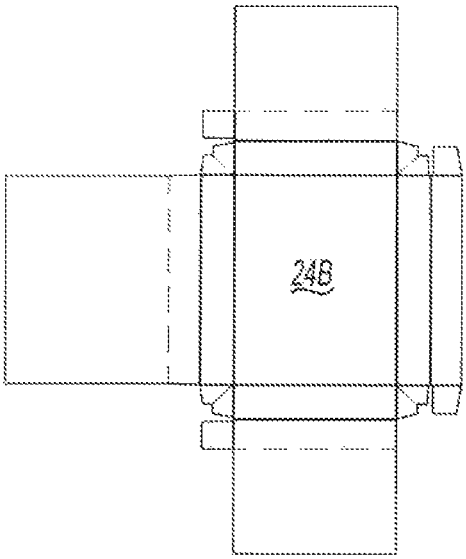
Figure 15D:
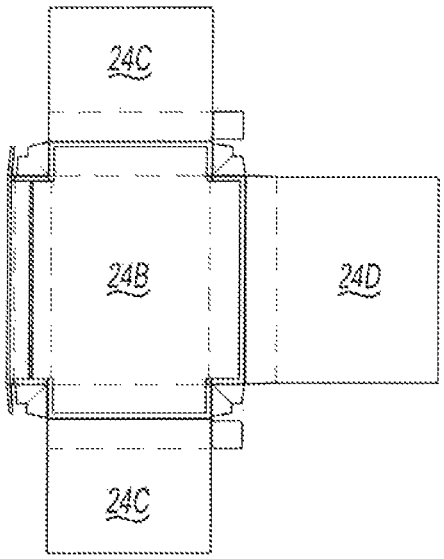
FIGS. 15D-15F are views of illustrative blanks in various stages of assembly in accordance with the present teachings.
Figure 15E:
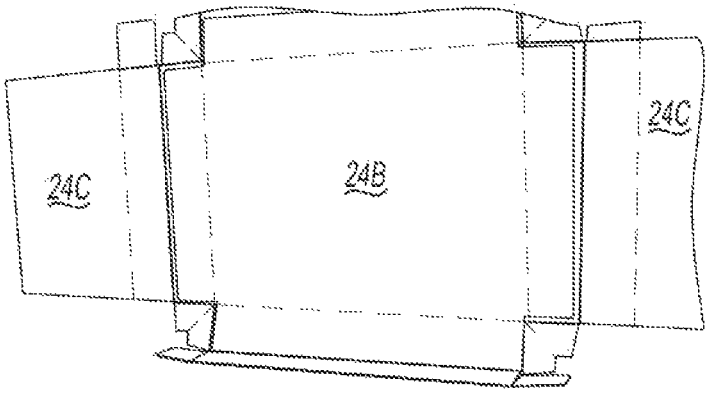
Figure 15F:
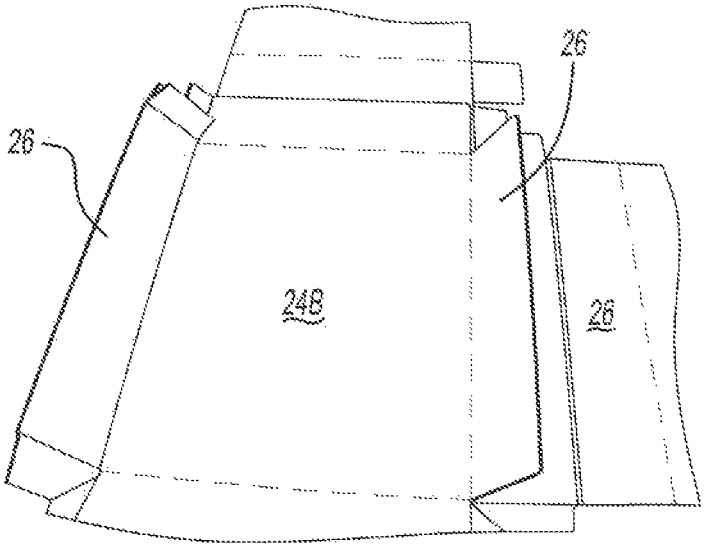
Figure 15G:
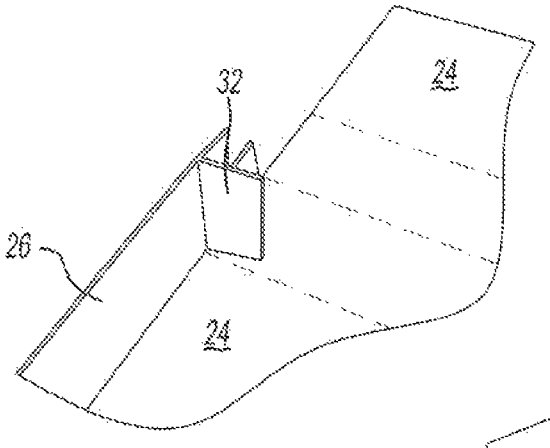
FIGS. 15G-15N are views of illustrative examples of container comes in various stages of assembly in accordance with the present teachings.
Figure 15H:
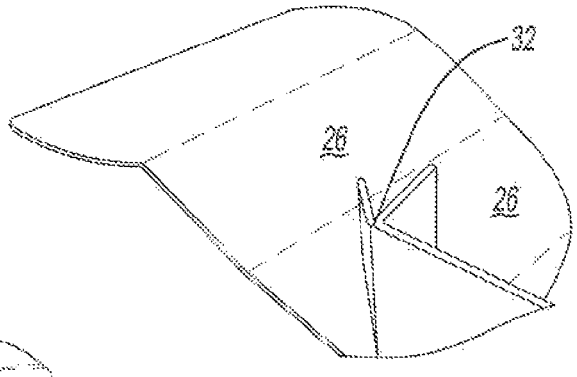
Figure 15I:
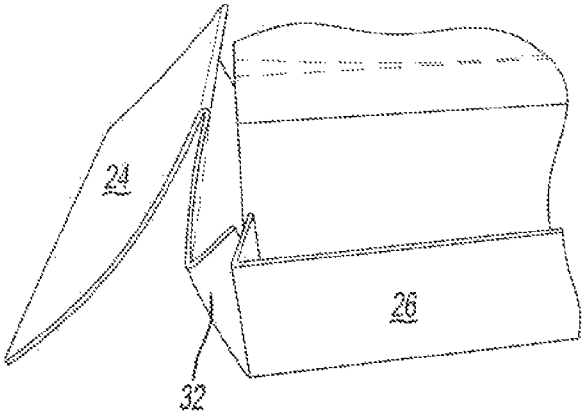
Figure 15J:
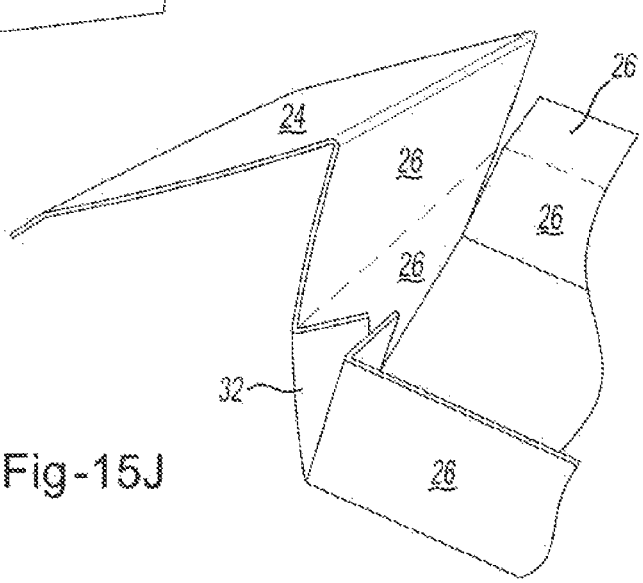
Figure 15K:
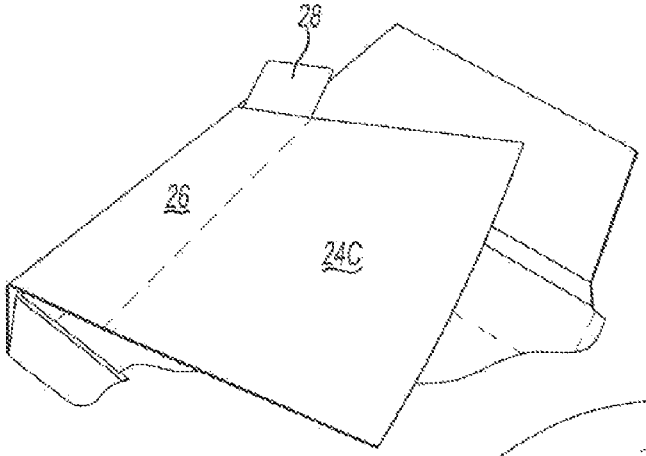
Figure 15L:
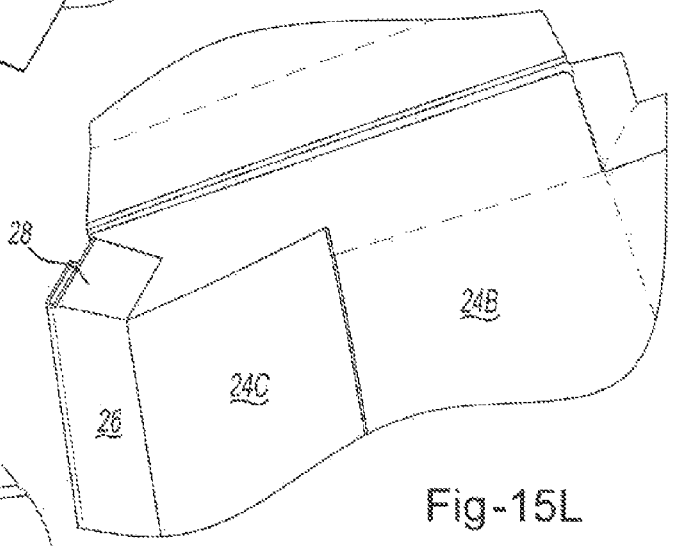
Figure 15M:
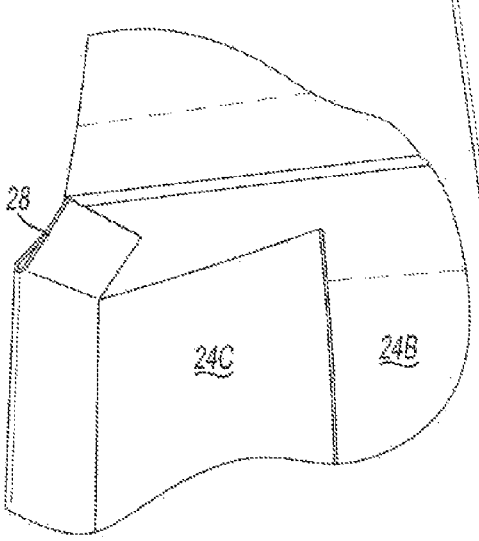
Figure 15N:
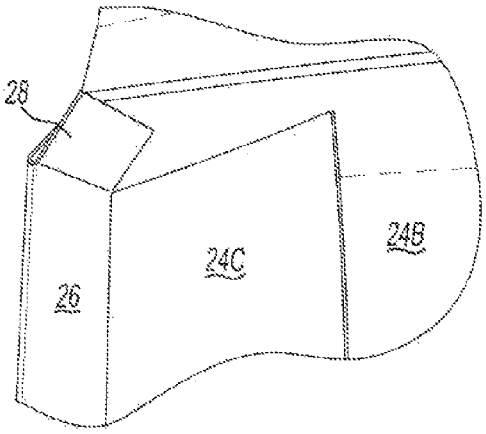
Figure 15O:
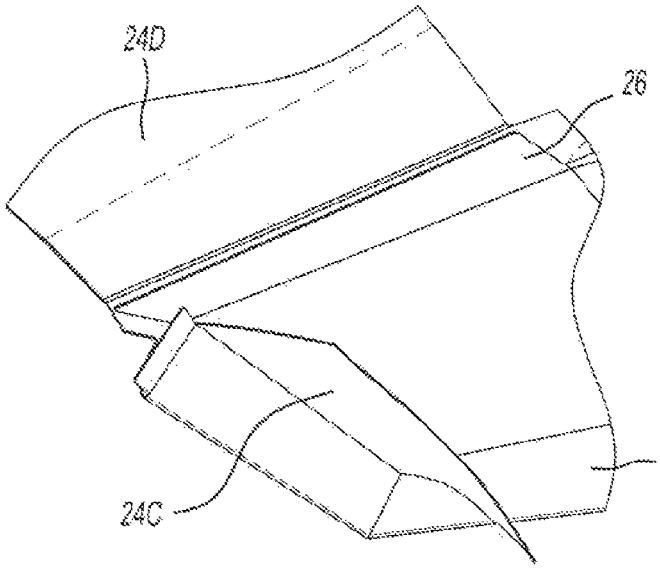
FIGS. 15O-15Q are views of illustrative blanks in various stages of assembly in accordance with the present teachings.
Figure 15P:
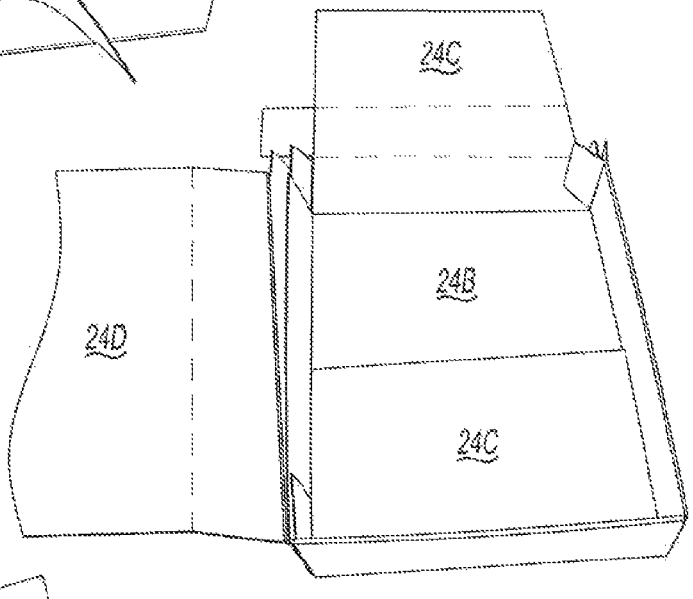
Figure 15Q:
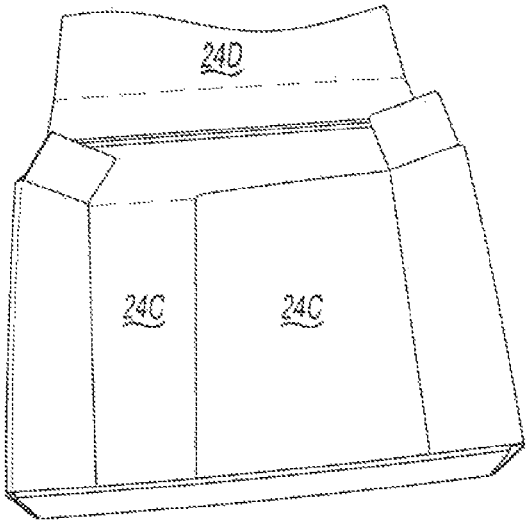
Figure 15R:
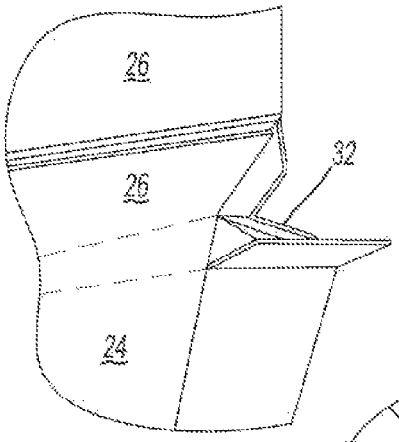
FIGS. 15R-15T are views of illustrative examples of container corners in various stages of assembly in accordance with the present teachings.
Figure 15S:
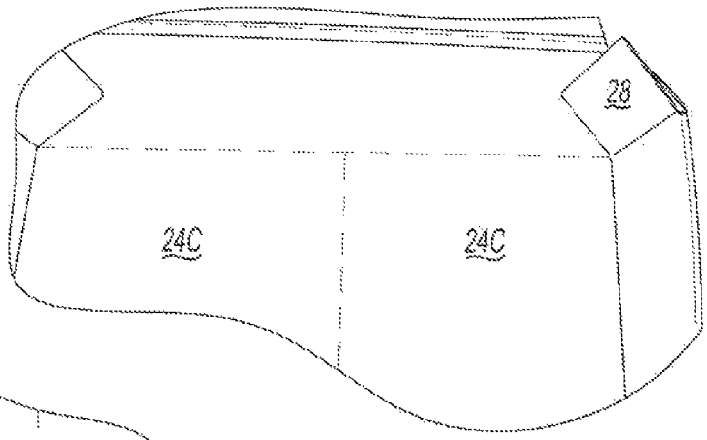
Figure 15T:
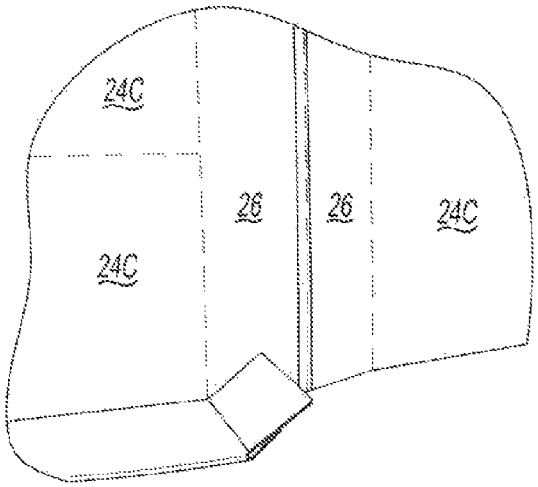
Figure 15U:
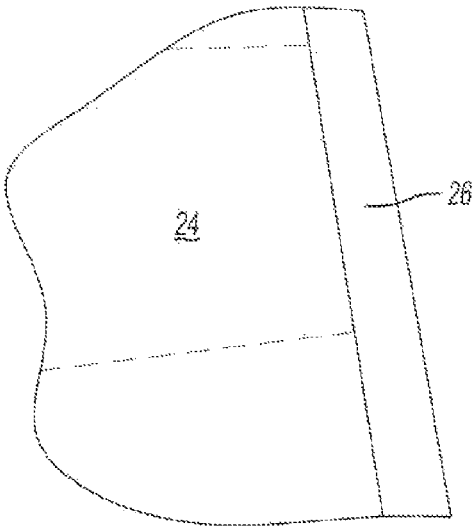
FIGS. 15U-15Z are views of illustrative examples of container portions including fold lines in various stages of assembly in accordance with the present teachings.
Figure 15V:
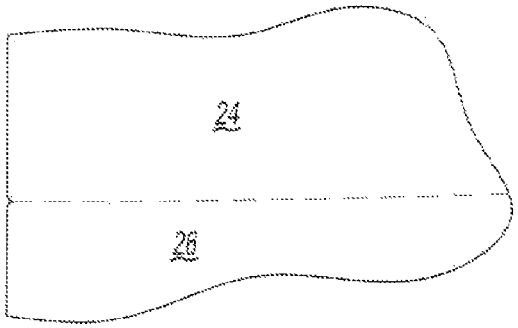
Figure 15W:
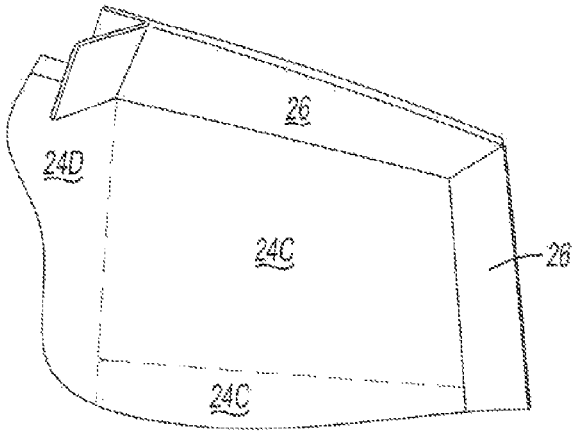
Figure 15X:
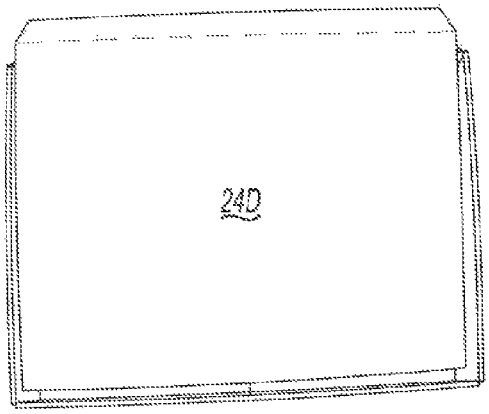
Figure 15Y:
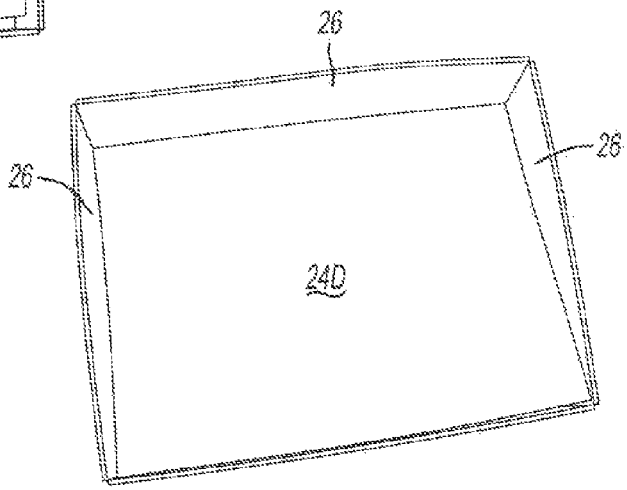
Figure 15Y:
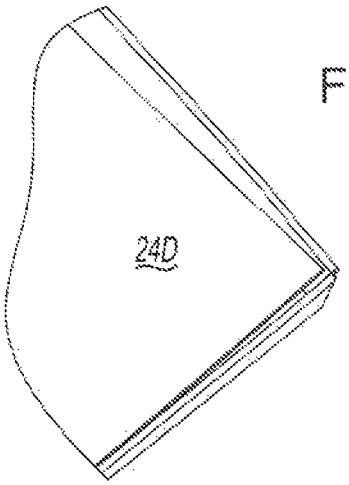
Figure 15Z:
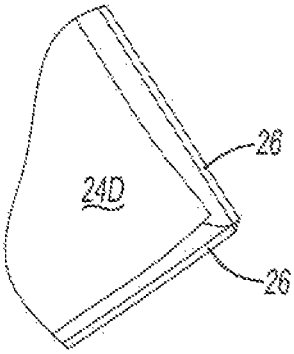

FIGS. 15A-15C illustrate steps that may be used in the assembling of a container from a blank. For example, base layer 24B (e.g., the second base layer) may be folded onto base layer 24A (e.g., the first base layer). This may occur prior to folding any additional base layers onto base layer 24A. FIGS. 15D-15F show additional view of folding 24B onto 24A such that 24C (e.g., the third base layer) and 24D (e.g., the fourth base layer) remain unfolded. Thus, folding 24B may be the first step in assembly of the container. FIGS. 15G-15J show varying assembly arrangements of the gussets 32 in relation to the wall layers 26 and base layers 24. As shown for example in FIG. 15J, one or more wall layers 26 may fold over and substantially cover at least a portion of the gusset 32 during assembly of the container. FIGS. 15O-15Q show a continued exemplary assembly process, where base layer 24C is folded over and onto (e.g., in direct planar contact with base layer 24B. Base layers 24C are shown as having a width that is less than the width of other base layers 24A, 24B, and 24D. Upon folding two base layers 24C onto base layer 24B, at least a portion of the base layers 24C may overlap with one another so that base layer 24B is substantially completely covered by base layers 24C. Alternatively, the base layers 24C may not contact one another. A portion of base layer 24B may thus still be visible even upon folding base layers 24C onto base layer 24B. FIGS. 15R-15U show additional exemplary steps in the container assembly process where the lateral projections 28 fold into the container and over (e.g., in direct planar contact with a wall, layer 26. This occurs generally prior to folding the base layer 24D onto (e.g., in direct planar contact with) onto the base layers 24C. The step of folding base layer 24D onto base layers 24C is shown for example at FIGS. 15V-15Z. The step of folding base layer 24D may be the final step in the container assembly process.

It should be noted that the order in which the various base layers are folded onto the base layer 24A may vary, such that base layers 24C may be folded onto base layer 24A before or after one or more of base layer 24B and base layer 24D. Further, one or more of base layers 24B, 24C, and 24D may be omitted from the blank. Also, any of base layers 24B, 24C and 24D may be formed of a single continuous, sheet or of more than one sheet being folded to join and form the layer.

Figure 16A:
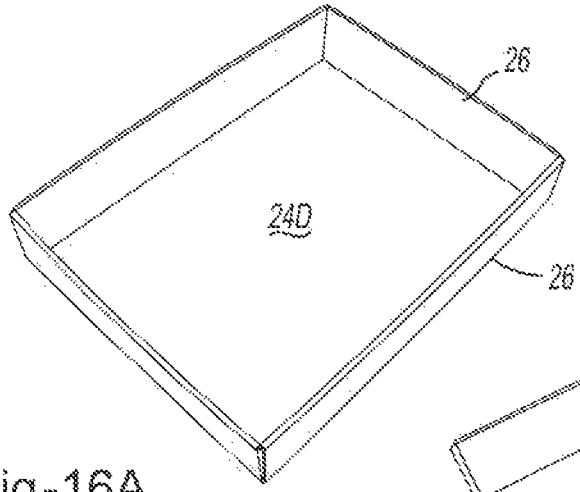
FIGS. 16A, 16B, and 16C are perspective views of assembled container portions in accordance with the present teachings.
Figure 16B:
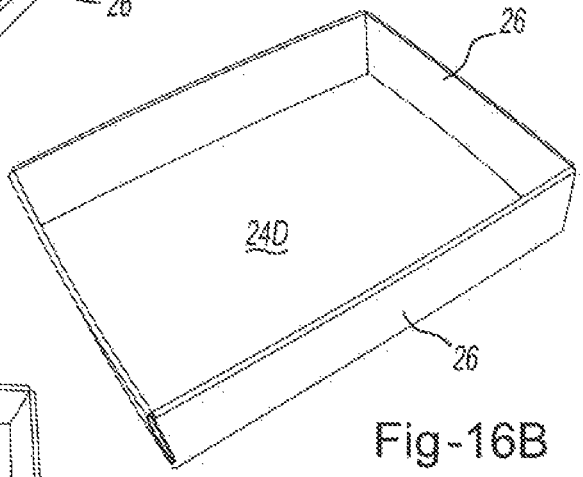
Figure 16C:
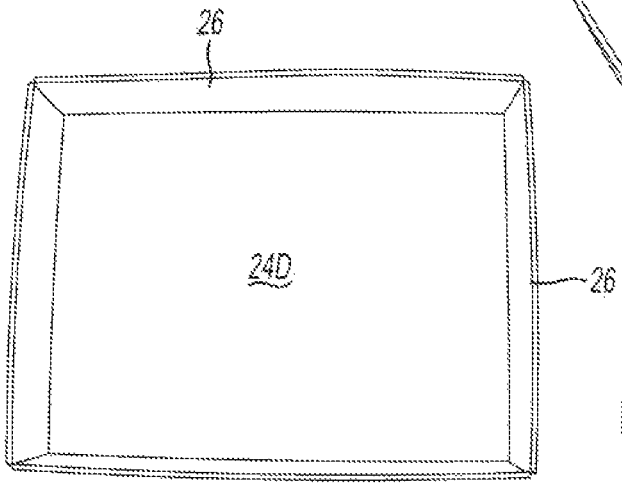

FIGS. 16A-C illustrate features of an assembled container according to the teachings herein. As an example, when the interior of the container is viewed from above (as shown), only base layer 24D may be visible.

Figure 17A:
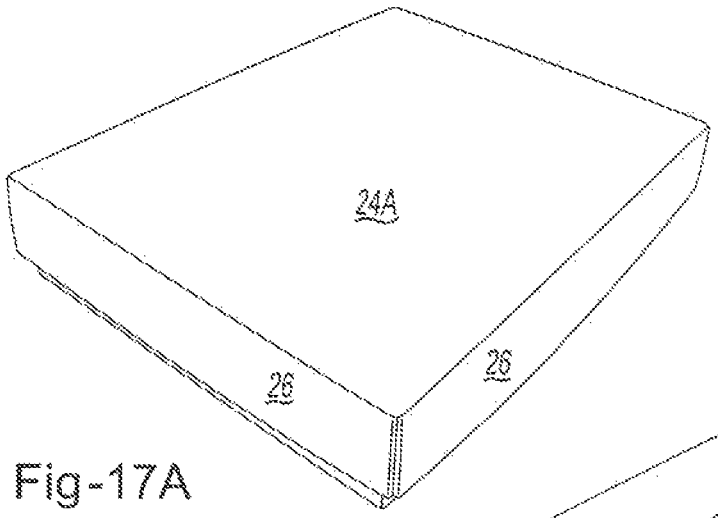
FIGS. 17A, 17B, and 17C are perspective views of an illustrative box including a container for a box bottom, a container for a box lid, having one or more containers according to the teachings herein.
Figure 17B:
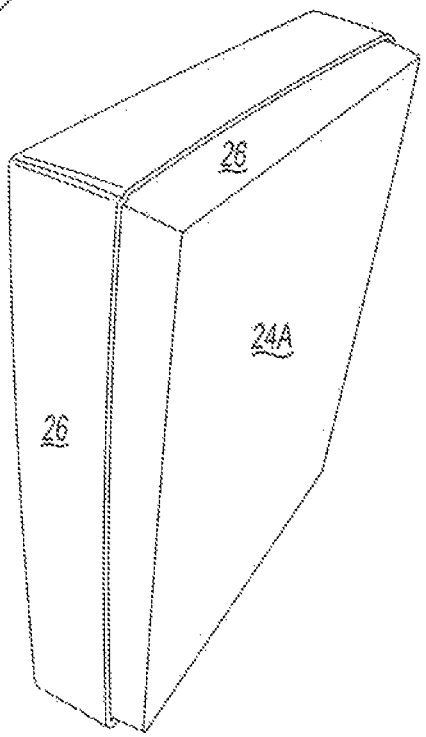
Figure 17C:
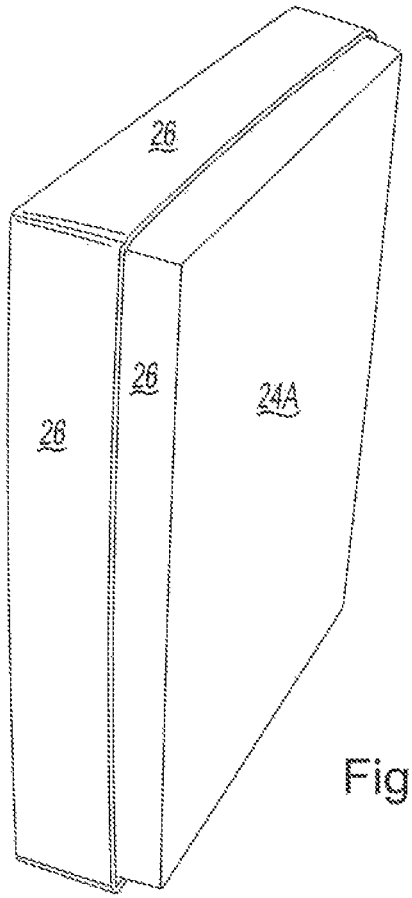

FIGS. 17A-C illustrate a box including two containers according to the teachings herein. As only the exterior portions of the resulting box are shown, only base layer 24A is visible in both the bottom of the box and the lid of the box.

The containers according to the teachings herein may be configured to receive one or more items for retail packaging purposes, for displaying purposes, for storage purposes, for transportation purposes, or any combination thereof. For example the container may be configured for receiving an electronic device (such as a consumer electronic device), a cosmetic, a kit, an article of clothing, a houseware item an automotive accessory, paper goods, a food item, or any combination thereof.

Though not necessarily drawn to al geometries relative proportions and dimensions shown in the drawings are also part of the teachings herein, even if not explicitly recited. However, unless otherwise stated, nothing shall limit the teachings herein to the geometries, relative proportions and dimensions shown in the drawing.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

What is claimed is:

1. A container comprising a tray; wherein the tray comprises:

a generally rectangular base portion having a first pair of peripheral edges and a second pair of peripheral edges;

a first pair of opposing spaced apart side walls each projecting generally orthogonally from respective edges of the first pair of peripheral edges;

a second pair of opposing spaced apart side walls each projecting generally orthogonally from respective edges of the second pair of peripheral edges and being connected with the first pair of opposing spaced apart side walls to define four corners;

wherein the container is constructed from a continuous single sheet of card stock having a first face and an opposing second face, and wherein one or both of the first face or the second face is adapted for printing directly onto its surface;

wherein the base portion includes at least two base layers of the single sheet that are folded from the continuous single sheet and each span substantially an entirety of the base portion to define the base portion and cooperate to define a portion of the first and second pair of side walls;

wherein an adhesive bonds at least two layers defining at least one of the side walls; and wherein one of the side walls has a length and includes three or more side wall layers including a first side wall layer, a second side wall layer and a third side wall layer, formed by folding the continuous single sheet and extending substantially the entire length of said side wall, the three or more side wall layers have facing surfaces that are flat and parallel and the second side wall layer has an edge connected directly with the first side wall layer and an opposing edge connected directly with the third side wall layer.

2. The container of claim 1, wherein the base portion includes three base layers that are folded from the continuous single sheet and each span substantially the entirety of the base portion, wherein the continuous single sheet has a thickness, and each of the base layers has a thickness equal to the thickness of the continuous single sheet.

3. The container of claim 1, wherein the container is free of any separate insert.

4. The container of claim 1, wherein the container consists of the tray, and one of the side walls includes four or more side wall layers.

5. The container of claim 4, wherein the continuous single sheet is a paperboard having a thickness of less than about 2 mm and the thickness each of the side wall layers is the thickness of paperboard; and wherein the base portion includes three base layers that are folded from the continuous single sheet and each span substantially the entirety of the base portion, and each of the three base layers has a thickness equal to the thickness of the paperboard.

6. The container of claim 1, wherein at least two of the two or more base layers are formed by two opposing base layers.

7. A box including one or more containers of claim 1.

8. The container of claim 1, wherein the container is configured to receive a electronic device, a cosmetic, a kit, an article of clothing, a houseware item, an automotive accessory, paper goods, a food item, or any combination thereof.

9. A die cut paperboard preform for a container of claim 1.

10. A die cut paperboard preform for a container of claim 1 having a thickness of less than about 2 mm.

11. A method of making a container, comprising folding the die cut paperboard preform of claim 9 for forming the container of claim 1.

12. A method of making the container of claim 1, wherein the method is free of any step of applying an adhesive to any base layer.

13. A container comprising a tray;

wherein the tray comprises:

a generally rectangular base portion having a first pair of peripheral edges and a second pair of peripheral edges;

a first pair of opposing spaced apart side walls each projecting generally orthogonally from respective edges of the first pair of peripheral edges;

a second pair of opposing spaced apart side walls each projecting generally orthogonally from respective edges of the second pair of peripheral edges and being connected with the first pair of opposing spaced apart side walls to define four corners;

wherein the container is constructed from a continuous single sheet of card stock having a first face and an opposing second face, and wherein one or both of the first face or the second face is adapted for printing directly onto its surface;

wherein the base portion includes at least two base layers of the single sheet that are folded from the continuous single sheet to define the base portion and cooperate to define a portion of the first and second pair of side walls;

wherein an adhesive bonds at least two layers defining at least one of the side walls; and wherein one of the side walls has a length and includes three or more side wall layers including a first side wall layer, a second side wall layer and a third side wall layer, formed by folding the continuous single sheet and extending substantially the entire length of said side wall, the three or more side wall layers have facing surfaces that are flat and parallel and the second side wall layer has an edge connected directly with the first side wall layer and an opposing edge connected directly with the third side wall layer;

wherein at least two of the two or more base layers overlap when folded onto the base portion.

14. A container comprising a tray; wherein the tray comprises:

a generally rectangular base portion having a first pair of peripheral edges and a second pair of peripheral edges;

a first pair of opposing spaced apart side walls each projecting generally orthogonally from respective edges of the first pair of peripheral edges;

a second pair of opposing spaced apart side walls each projecting generally orthogonally from respective edges of the second pair of peripheral edges and being connected with the first pair of opposing spaced apart side walls to define four corners;

wherein the container is constructed from a continuous single sheet of card stock having a first face and an opposing second face, and wherein one or both of the first face or the second face is adapted for printing directly onto its surface;

wherein the base portion includes at least two base layers of the single sheet that are folded from the continuous single sheet to define the base portion and cooperate to define a portion of the first and second pair of side walls;

wherein an adhesive bonds at least two layers defining at least one of the side walls; and wherein one of the side walls has a length and includes three or more side wall layers including a first side wall layer, a second side wall layer and a third side wall layer, formed by folding the continuous single sheet and extending substantially the entire length of said side wall, the three or more side wall layers have facing surfaces that are flat and parallel and the second side wall layer has an edge connected directly with the first side wall layer and an opposing edge connected directly with the third side wall layer;

wherein the tray includes a first base layer, a second base layer, a third base layer and a fourth base layer each having a thickness equal to the thickness of the continuous single sheet; the first pair of opposing side walls are a first side wall and a second side wall, and the second pair of opposing side walls are a third side wall and a fourth side wall; and each of the first, second, third and fourth side wall includes at least two side wall layers;

wherein i. the first base layer has four edges each connected to one of the at least two side wall layers of each of the first, second, third and fourth side walls; and ii. the second base layer has four edges each connected to a different one of the at least two side wall layer of each of the first, second, third, and fourth side walls.

15. The container of claim 14, wherein the at least two base layers that are folded from the continuous single sheet each span substantially the entirety of the base portion.

16. A method of making the container of claim 14 including folding the second base layer onto the first base layer so that it lies in direct planar contact with the first base layer.

17. The method of claim 16 including folding the third base layer onto the second base layer so that it lies in direct planar contact with the second base layer.

18. The method of claim 17 including folding the fourth base layer onto the third base layer so that it lies in direct planar contact with the third base layer.

19. The method of claim 17, wherein the third base layer is formed by two separate panels folded toward one another to form the third base layer so that the third base layer substantially completely covers the second base layer.

20. A container comprising a tray, wherein the tray comprises:

a generally rectangular base portion having a first pair of peripheral edges and a second pair of peripheral edges;

a first pair of opposing spaced apart side walls each projecting generally orthogonally from respective edges of the first pair of peripheral edges;

a second pair of opposing spaced apart side walls each projecting generally orthogonally from respective edges of the second pair of peripheral edges and being connected with the first pair of opposing spaced apart side walls to define four corners;

wherein the container is constructed from a continuous single sheet having a first face and an opposing second face, and having a thickness;

wherein the base portion includes at least two base layers of the single sheet that are folded from the continuous single sheet to define the base portion and cooperate to define a portion of the first and second pair of side walls;

wherein an adhesive bonds at least two layers defining at least one of the side walls; wherein the at least two base layers includes a first base layer and a second base layer each having a thickness equal to the thickness of the continuous single sheet, the first pair of opposing side walls includes a first side wall having multiple side wall layers and a second side wall having multiple side wall layers, wherein the first base layer includes a first edge connected to one of the multiple side wall layers of the first side wall and a second edge connected to one of the multiple side wall layers of the second side wall, and the second base layer includes a first edge connected to one of the multiple side wall layers of the first side wall and a second edge connected to one of the multiple side wall layers of the second side wall; wherein each of the side wall layers extends substantially the length of the corresponding side wall, wherein the first side wall has a length and the multiple side wall layers of the first side wall includes three or more side wall layers formed by folding the continuous single sheet and extending substantially the entire length of the first side wall, wherein the three or more side wall layers includes a first side wall layer directly connected to a first edge of a second side wall layer and a third side wall layer directly connected to a second edge of the second side wall layer; and wherein the first, second and third side wall layers each have a thickness equal to the thickness of the continuous single sheet.

* * * * *